US007477757B2

(12) United States Patent
Stiles

(10) Patent No.: US 7,477,757 B2
(45) Date of Patent: Jan. 13, 2009

(54) DUAL-GAP TRANSDUCER WITH RADIALLY-CHARGED MAGNET

(75) Inventor: Enrique M. Stiles, Imperial Beach, CA (US)

(73) Assignee: STEP Technologies Inc., Minneapolis, MN (US)

( * ) Notice: Subject to any disclaimer, the term of this patent is extended or adjusted under 35 U.S.C. 154(b) by 391 days.

(21) Appl. No.: 11/105,779

(22) Filed: Apr. 13, 2005

(65) Prior Publication Data

US 2005/0190946 A1 Sep. 1, 2005

Related U.S. Application Data

(63) Continuation-in-part of application No. 10/289,109, filed on Nov. 5, 2002, now Pat. No. 6,996,247.

(51) Int. Cl.
*H04R 9/06* (2006.01)

(52) U.S. Cl. ..... 381/419; 381/412

(58) Field of Classification Search ..... 381/150, 381/396, 401, 412, 419, 420, 422, 96, 400, 381/402, 413, 414, 416, 421; 310/81
See application file for complete search history.

(56) References Cited

FOREIGN PATENT DOCUMENTS

DE 19724373 A1 * 12/1998
JP 2003-061190 * 2/2003

* cited by examiner

*Primary Examiner*—Brian Ensey
(74) *Attorney, Agent, or Firm*—Richard Calderwood

(57) ABSTRACT

An electromagnetic transducer such as an audio speaker, having a multi-gap geometry in which there are two or more magnetic air gaps over which magnetic flux flows in a same radial orientation. The magnetic flux is provided by one or more radially-charged magnets.

10 Claims, 20 Drawing Sheets

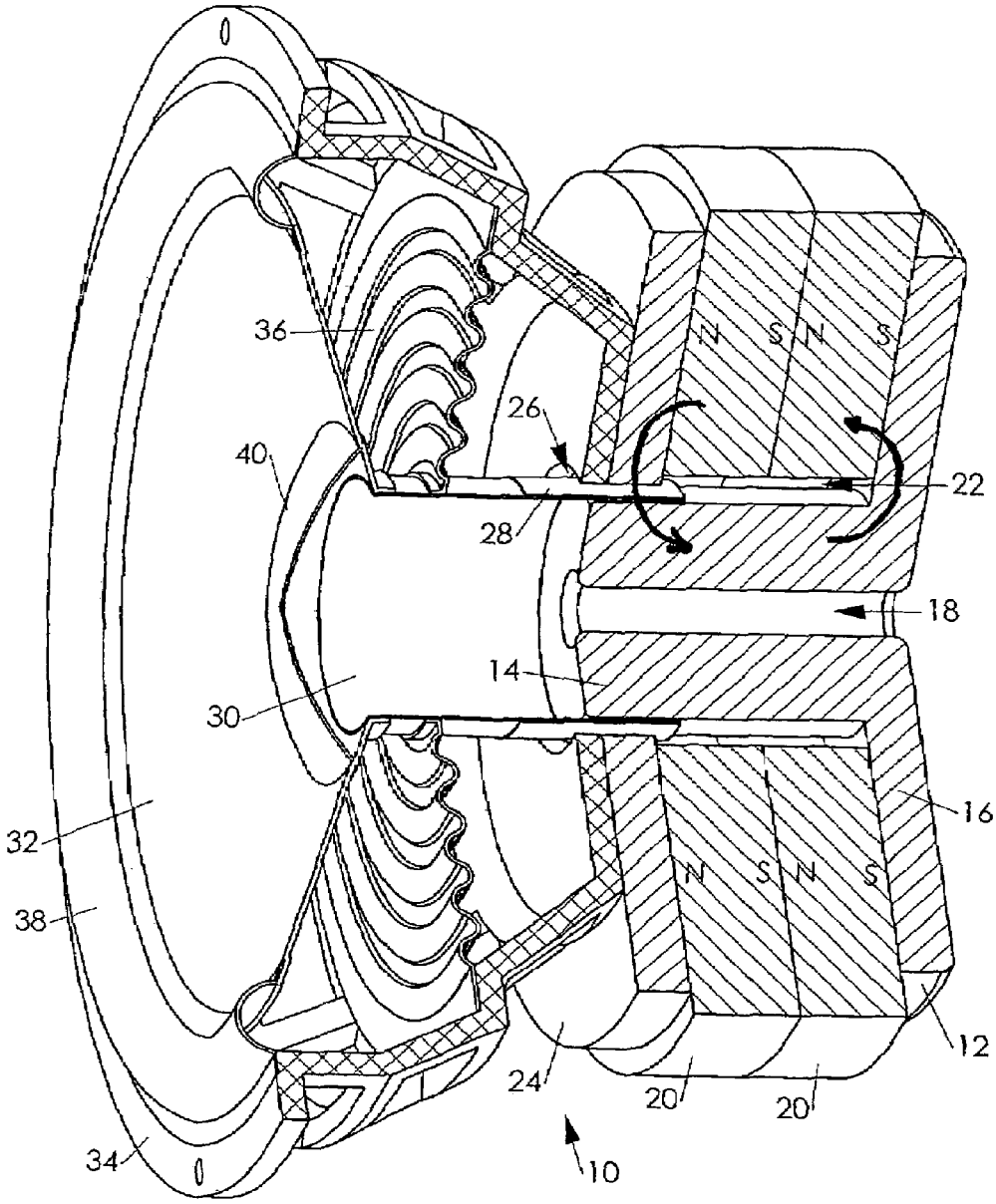
FIG. 1 - prior art

90

100

100

100

100

140

160

170

180

270

310

DUAL-GAP TRANSDUCER WITH RADIALLY-CHARGED MAGNET

RELATED APPLICATION

This application is a continuation-in-part of application Ser. No. 10/289,109 entitled "Push-Push Multiple Magnetic Air Gap Transducer" filed Nov. 5, 2002 by this inventor, which has issued as U.S. Pat. 6,996,247. Both are commonly assigned.

BACKGROUND OF THE INVENTION

1. Technical Field of the Invention

This invention relates generally to electromagnetic transducers such as audio speakers, and more specifically to a multiple magnetic air gap geometry for such.

2. Background Art

Speakers are shown in cross-section in this document. Because speakers are generally cylindrically or rotationally symmetrical about an axis line or center line, only one side of any given speaker is shown, but the skilled reader will readily appreciate the three-dimensional structure which is thus represented. The reader will appreciate, however, that the invention is not limited to such axially symmetric implementations.

FIG. 1 illustrates a conventional audio speaker 10 such as is known in the prior art, shown as symmetrical about a center line CL. The speaker includes a magnetically conductive pole plate 12 which includes a pole 14 which may be either coupled to or integral with the base 16 of the pole plate, as shown. The pole may include an axial hole 18 for permitting airflow to cool the motor structure and depressurize the diaphragm assembly. A ring-shaped permanent magnet 20 surrounds the pole, with a cavity 22 between them. A magnetically conductive top plate 24 surrounds the pole, with a magnetic air gap 26 between them. Typically, the magnetic air gap will be smaller than the cavity. The pole plate, magnet, and top plate may collectively be termed a magnet assembly or a motor structure. The heavy black arrows denote exemplary directions of flux flow, throughout this document; the skilled reader will readily appreciate that the magnets may be reversed, and the flux will flow the opposite direction, and the transducer will operate correctly, especially when provided with an inverse phase electrical input signal.

An electrically conductive voice coil 28 is rigidly attached to a cylindrical bobbin or voice coil former 30. The voice coil is suspended within the magnetic air gap to provide mechanical force to a diaphragm 32 which is coupled to the bobbin. When an alternating current is passed through the voice coil, the voice coil moves up and down in the air gap along the axis of the speaker, causing the diaphragm to generate sound waves.

A frame 34 is coupled to the magnet assembly. There are two suspension components. A damper or spider 36 is coupled to the bobbin and the frame, and a surround 38 is coupled to the diaphragm and the frame. These two suspension components serve to keep the bobbin and diaphragm centered and aligned with respect to the pole, while allowing axial movement. A dust cap 40 seals the assembly and protects against infiltration of dust particles and other stray materials which might contaminate the magnetic air gap and thereby interfere with the operation or quality of the speaker.

When, as shown, the voice coil is taller (along the axis) than the magnetic air gap, the speaker is said to have an "overhung" geometry. If, on the other hand, the voice coil were shorter than the magnetic air gap, the speaker would be "underhung".

If the voice coil moves so far that there exists a different number of voice coil turns within the air gap (i.e. an overhung voice coil has moved so far that one end of it has entered the air gap, or an underhung voice coil has moved so far that one end of it has left the air gap), the speaker begins to exhibit nonlinear characteristics, and the sound quality is distorted or changed. This is especially problematic when playing low frequency sounds at high volume, which require maximum voice coil travel.

The common approach to solving this problem has been to use highly overhung or highly underhung geometries to achieve a high degree of linear voice coil travel. These approaches have inherent limitations, however. The highly overhung motor requires increasingly longer coils, which in turn increases the total moving mass of the diaphragm assembly. At some point, this ever-increasing mass becomes so great that the inherent mechanical design limits are reached, which prevents any further controllable increase in excursion. At the same time, increasing the voice coil mass with no resultant increase in utilized magnetic flux will reduce the overall efficiency of the transducer. Efficiency is proportional to BL squared, and inversely proportional to mass squared. In the highly underhung geometry, other practical limits are reached because of the relative increase in magnet area required to maintain a constant B across the magnetic gap height in order to achieve higher linear excursions without sacrificing efficiency. Unfortunately, this increase in available magnetic flux, B, does not result in an increase in BL, and therefore the transducer's efficiency also does not increase.

One hybrid approach has been to provide the bobbin with two tandem voice coils which travel in two respective magnetic air gaps, such as is taught in U.S. Pat. No. 4,783,824 to Kobayashi and U.S. Pat. No. 5,740,265 to Shirakawa. These are both "push-pull" geometries, in which the magnetic flux over the top magnetic air gap travels in the opposite direction as the flux over the bottom magnetic air gap; this requires that the two voice coils be wound in opposite directions, and it requires twice the total voice coil length and a longer bobbin without increasing the total linear excursion, all of which add manufacturing cost with minimal benefit. Kobayashi further teaches that the voice coils may be wound in the same direction if the currents through them are of opposite phases. Unfortunately, this requires each voice coil to have its own, dedicated pair of electrical inputs, which further increase the complexity and cost of the transducer.

In the prior art overhung speakers, 100% of the magnetic air gap is always active during linear operation. In the prior art underhung speakers, 100% of the voice coil windings are always active during linear operation.

Speakers may generally be classified as having an external magnet geometry (in which ring magnets surround a pole plate) or an internal magnet geometry (in which a cup contains magnets). Pole plates and cups may collectively be termed magnetic return path members or yokes, as they serve as the return path for magnetic flux which has crossed over the magnetic air gap.

Materials may be classified as either magnetic materials or non-magnetic materials. Non-magnetic materials may also be termed non magnetically conductive materials; aluminum and chalk are examples of non-magnetic materials. Magnetic materials are classified as hard magnetic materials and soft magnetic materials. Hard magnetic materials are also called permanent magnets, and generate magnetic flux fields without outside causation. Soft magnetic materials are those which, although not permanent magnets, will themselves become magnetized and generate flux in response to their being placed in a magnetic field. Soft magnetic materials include the ferrous metals such as steel and iron.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 1 shows, in cross-section, a conventional speaker geometry according to the prior art.

DETAILED DESCRIPTION

The invention may be utilized in a variety of magnetic transducer applications, including but not limited to audio speakers, microphones, mechanical position sensors, actuators (which can be linear motors), and the like. For the sake of convenience, the invention will be described with reference to audio speaker embodiments, but this should be considered illustrative and not limiting. The invention may prove especially useful in high ("large") excursion applications such as subwoofer speakers, but, again, this should not be considered limiting.

This invention permits the simultaneous utilization of less than 100% of the magnetic air gap and less than 100% of the voice coil windings. For example, this invention allows optimum linear excursion to be achieved with the simultaneous utilization of 50% of the voice coil windings and 33% of the magnetic gap, or as another example, 66% of the magnetic gap and 33% of the voice coil windings could be obtained. A multitude of ratios are possible. This allows the designer to achieve a desired balance between, or combination of: high frequency extension, low frequency extension and enclosure volume, efficiency, linear excursion, cost, power handling, and size of the motor structure. The designer can now achieve a much broader range of combinations than were previously attainable.

Figure 2A:
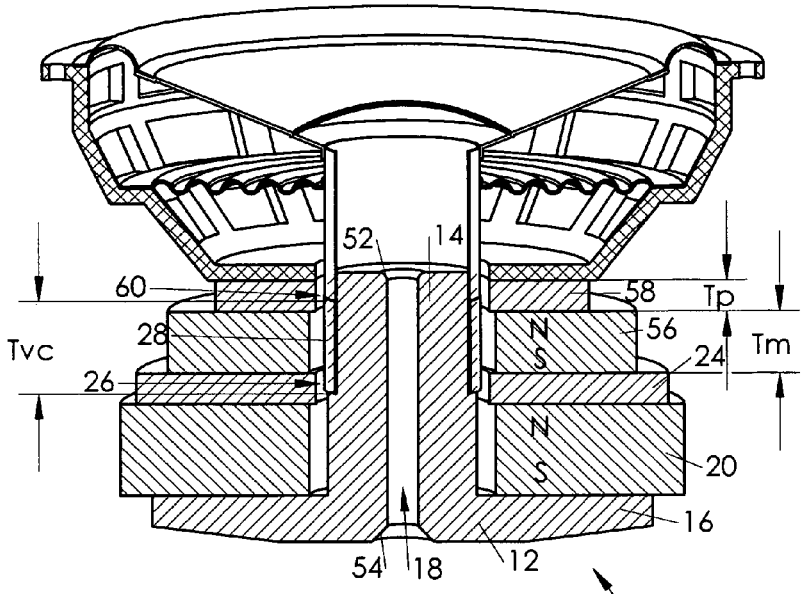
FIGS. 2A-C show, in cross-section, one embodiment of a speaker geometry according to this invention, having one voice coil and having two air gaps over which the magnetic flux is in the same direction.

FIG. 2A illustrates one embodiment of a speaker 50 according to this invention. The speaker includes a pole plate 12 including a back plate 16 and a pole piece 14 which can be either integral with or coupled to the back plate. In some embodiments, there may be a hole 18 extending through the length of the pole piece to permit air flow in response to the bellows action of the speaker. In some embodiments, it may be advantageous to adapt this hole with beveled ends 52, 54, for improved aerodynamic performance with less turbulence, allowing the use of a smaller hole or vent without causing too much distortion. If the vent is made too large, the magnetic efficiency is reduced, because of the reduced quantity of steel in the pole, which in turn could lead to magnetic saturation of the steel.

The magnet assembly includes a first permanent magnet 20, first plate 24, and first magnetic air gap 26 as in the prior art. The invention further includes a magnetic material member 56 which may, in some embodiments, be a second permanent magnet. Unlike in the prior art dual gap speakers, the magnetic material member is oriented with its flux in the same direction as the first magnet, or, in other words, such that the first magnet 20 and the magnetic material member 56 have opposite poles facing each other. The speaker further includes a second plate 58 which defines a second magnetic air gap 60.

The frame and the diaphragm assembly including the bobbin or tube, diaphragm, spider, surround, and dust cover may be substantially as known in the prior art. The voice coil, first plate, second magnet, and second plate may advantageously be sized such that the voice coil extends from the center of one plate to the center of the other plate. The voice coil may advantageously have a height Tvc which is substantially equal to the height Tm of the second magnet plus the height Tp of the second plate (which in most instances should be the same height as the first plate so the two air gaps are of equal height). In order to travel into a nonlinear response region, the voice coil would have to travel so far as to have its bottom end enter the upper second air gap, or its top end enter the lower first air gap. This gives the voice coil a peak-to-peak linear travel equal to the height (thickness) Tp of the upper top plate plus twice the height Tm of the space between the magnetic air gaps. In an optimized configuration, the two plates are of equal thickness, and the second magnet 56 should be at least as thick as either of the plates.

The relative sizes of the magnets, plates, pole plate, and pole piece can be determined according to the specific requirements of a particular application, and are well within the abilities of ordinary skilled speaker designers, once armed with the teachings of this patent. For example, it may often be the case that the lower magnet will need to be larger (or, more to the point, more powerful) than the upper magnet, in order to have equal flux through the two air gaps, because the lower plate, between the magnets, will shunt some percentage of the lower magnet's flux directly into the upper magnet rather than through the first air gap.

Figure 2B:
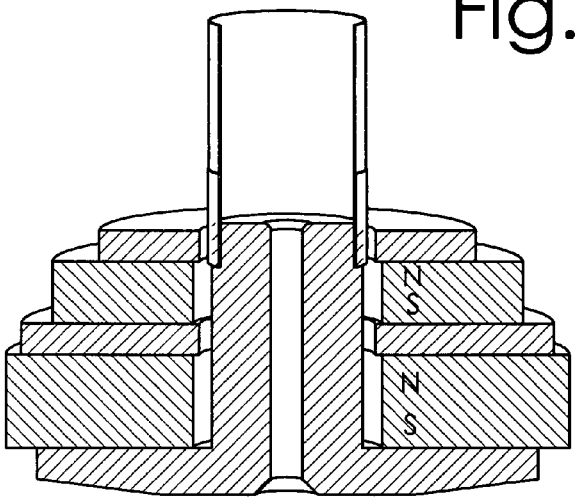
Figure 2C:
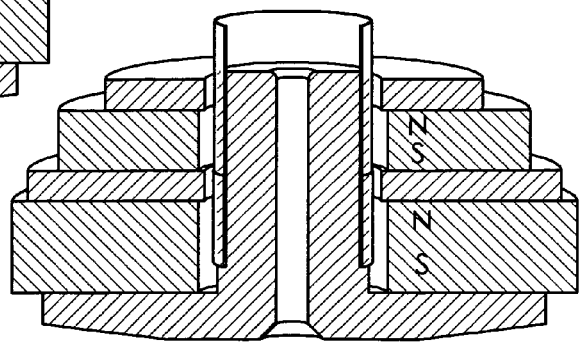

FIGS. 2B and 2C illustrate the embodiment of FIG. 2A with the voice coil at the points of maximum extension and retraction, respectively, in the region of linear excursion (Xmax). The reader should note that in all three FIGS. 2A-C, there is an equivalent of one magnetic air gap active (100% of the top magnetic air gap in FIG. 2B, 50% of each of the two magnetic air gaps in FIG. 2A, and 100% of the bottom magnetic air gap in FIG. 2C), and a total of one magnetic air gap's height of voice coil windings active. At any given point in the linear excursion realm, 50% of the total available magnetic air gap is active, with a corresponding length of voice coil, which is equal to Tvc minus Tm.

Figure 3A:
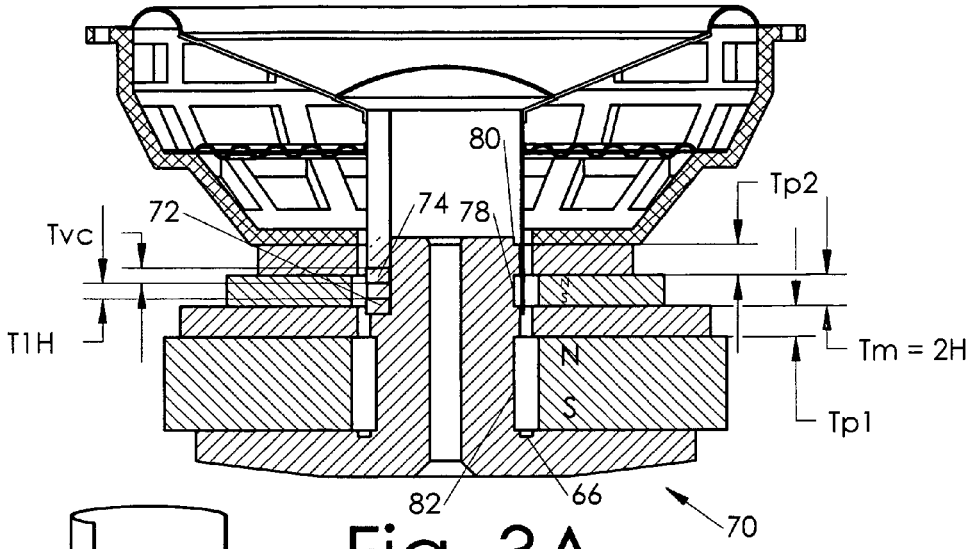
FIGS. 3A-C show, in cross-section, a second embodiment of a speaker, having two same direction magnetic flux air gaps and two tandem voice coils.

FIG. 3A illustrates a second embodiment of a speaker geometry 70 according to this invention, which is similar to the first embodiment except that it includes two voice coils 72, 74. Ideally, the two voice coils should be of the same height, and the distance from the center of one to the center of the other should equal the distance between the two air gaps (or, in other words, the thickness of the magnetic material member which is between their respective plates). In the optimum configuration with optimized linearity, the space between the two plates and each of the two plates should be of equal thickness, and this thickness should be the same as the height, Tvc, of one of the voice coils plus the space, Ts, between the voice coils, so that when, for example, the top voice coil is just beginning to exit the top of the top magnetic air gap during extension, the bottom voice coil will be just beginning to enter the top magnetic air gap.

Figure 3B:
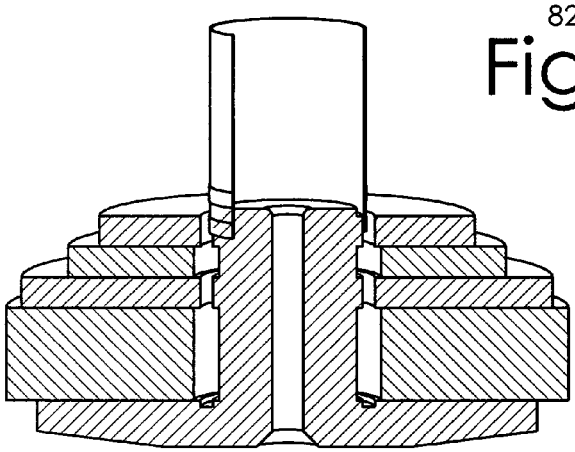
Figure 3C:
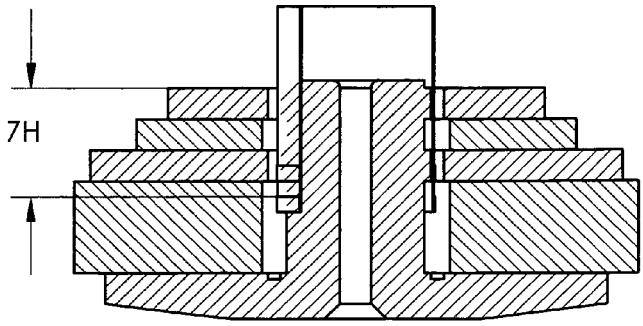

FIGS. 3A-C illustrate one very optimized embodiment, in which the height Tvc of each voice coil is a distance H, the height Tp1, Tp2 of each magnetic air gap is a distance 2H, and the distance Tm between the magnetic air gaps is 2H. Note that Ts=H=Tvc. This geometry gives a linear peak-to-peak excursion of 7H; at one extreme, the top edge of the bottom voice coil is even with the top of the top magnetic air gap, and at the other extreme, the bottom edge of the top voice coil is even with the bottom of the bottom magnetic air gap.

In one embodiment, the voice coils are wound in the same direction, and the electrical signal is applied to them in the same polarity. In another embodiment, the voice coils are wound in opposite directions, and they receive opposite polarity electrical signals.

Optionally, the pole plate may be adapted with a groove 66 into which the voice coil bobbin may extend at its maximum downward excursion, preventing the bobbin from striking the pole plate, which would grossly distort the sound and possibly damage the bobbin or voice coil and/or other components. This is taught in U.S. Pat. No. 5,715,324 to Tanabe et al.

In one mode, the pole piece may be adapted with a groove 78 substantially opposite the spacer or magnet between the air gaps, a groove 80 above the upper magnetic air gap, and a groove 82 below the lower magnetic air gap, to further improve linearity by concentrating more of the flux into the air gaps and creating symmetrical fringing fields above and below the edges of each air gap.

The reader should note that, in all three FIGS. 3A-C, there are 50% of the total available voice coil windings active in magnetic air gap(s), and 25% of the total available magnetic air gap is being used, during linear operation of the transducer.

Figure 4:
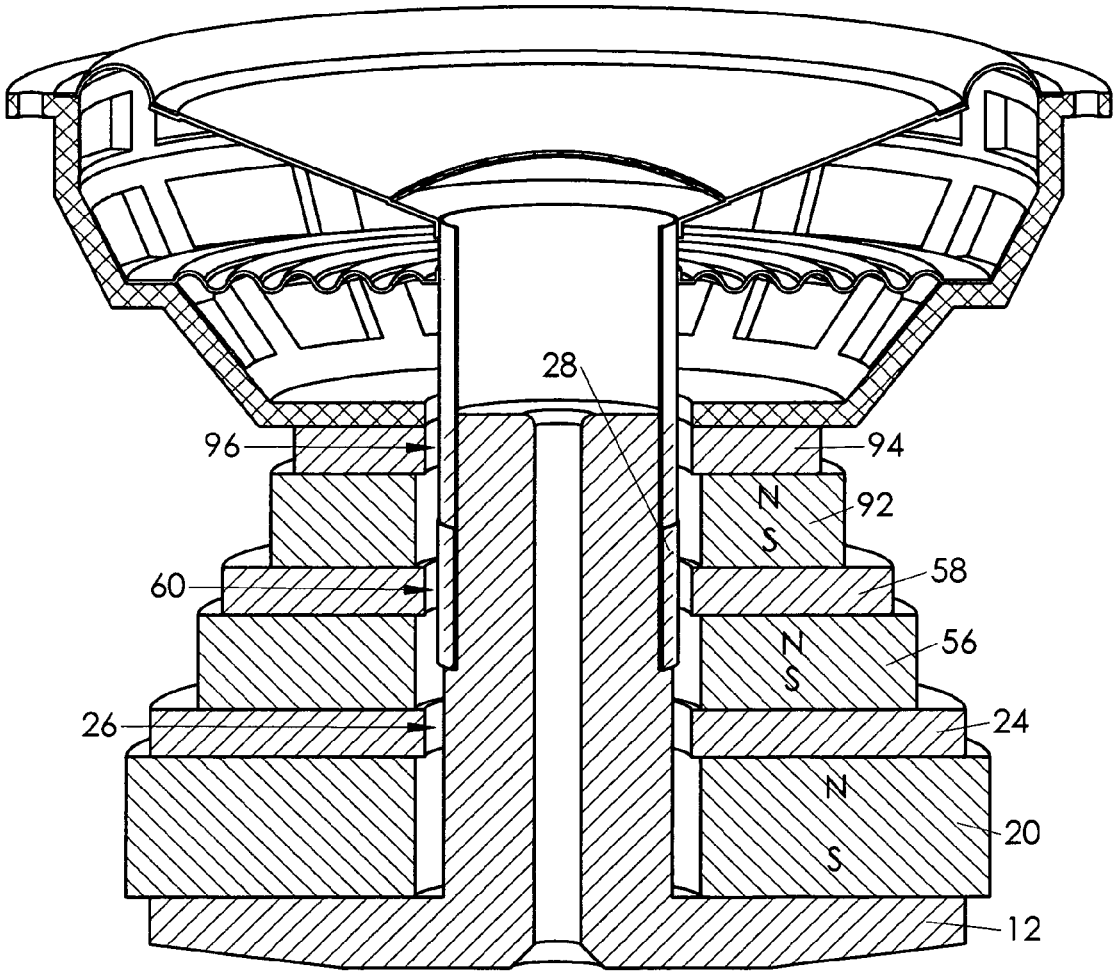
FIG. 4 shows, in cross-section, a third embodiment of a speaker geometry, having three air gaps and one voice coil.

FIG. 4 illustrates a third embodiment of a speaker geometry 90 according to this invention. The speaker includes a pole plate 12, first magnet 20, first plate 24, magnetic material member 56, second plate 58, and other components generally similar to those of the first embodiment. The speaker further includes a top magnetic material member 92 and a third plate 94 to define a third magnetic air gap 96. By including three or more air gaps, the total linear excursion of the voice coil can be made very large. By utilizing plates of the same thickness, and magnets of the same thickness (which may or may not be the same as the thickness of the plates, if a single voice coil is used), and by appropriately sizing the diameters of the magnets and plates, the flux density can be made substantially equal over each of the gaps, which results in optimum linearity over the entire range of linear voice coil travel. Selection of the particular thicknesses and diameters is well within the ordinary skill of those in this field armed with the previous discussion, and need not be discussed in detail here.

FIGS. 5A-F illustrate a fourth embodiment of a speaker geometry 100 which is similar to that of FIG. 4. The speaker includes pole plate 12, primary magnet 20, first gap plate 24, magnetic material member 56, second gap plate 58, magnetic material member 92, third gap plate 94, and bobbin 30, as well as the rest of the diaphragm assembly (not shown). The speaker further includes a voice coil 102 which extends from the center of the top magnetic air gap to the center of the bottom magnetic air gap, as shown. The speaker may optionally include a magnetically conductive spacer 104, if the primary magnet is not sufficiently thick to allow clearance for full voice coil travel.

Figure 5A:
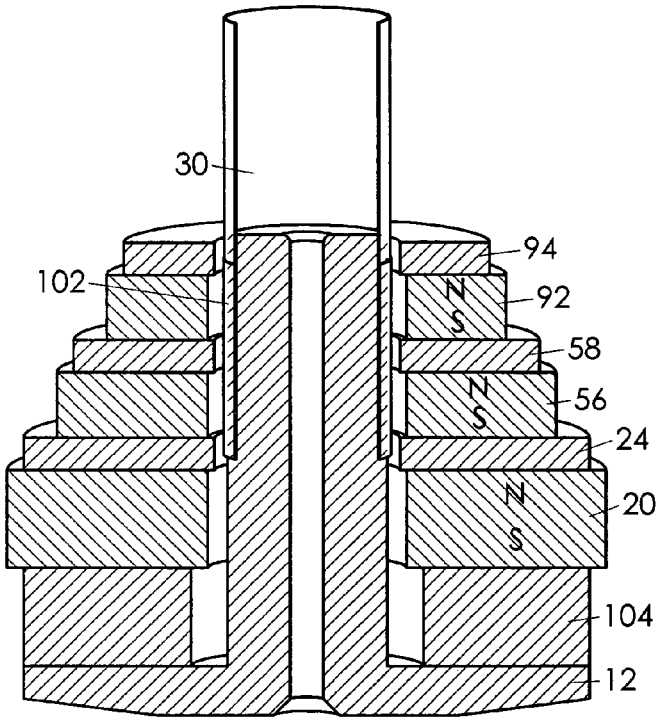
FIGS. 5A-F show, in cross-section, a fourth embodiment of a speaker geometry, having three air gaps and a single voice coil.
Figure 5B:
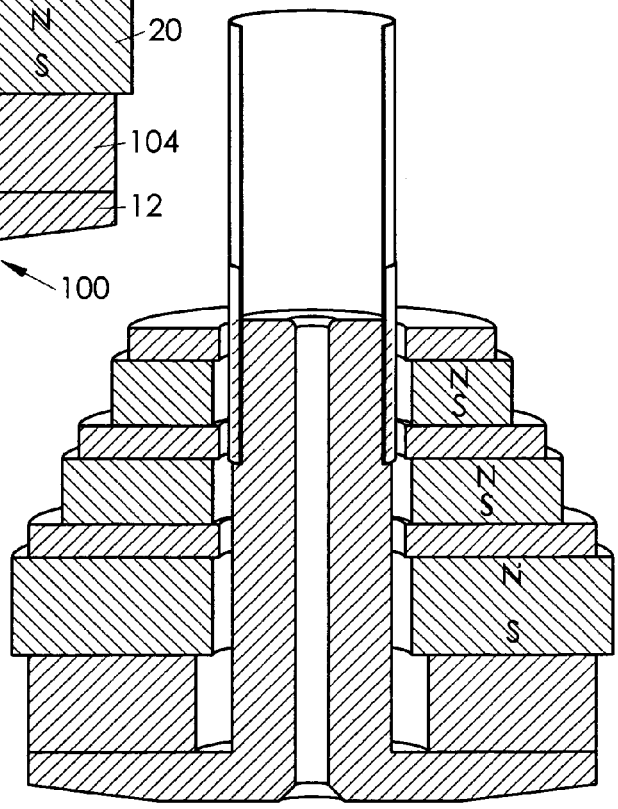
Figure 5C:
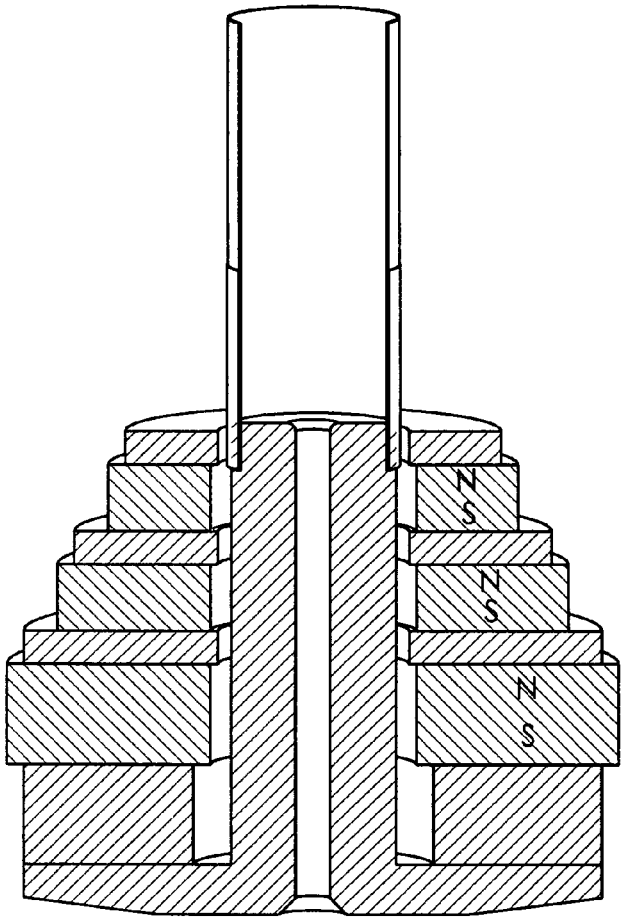
Figure 5D:
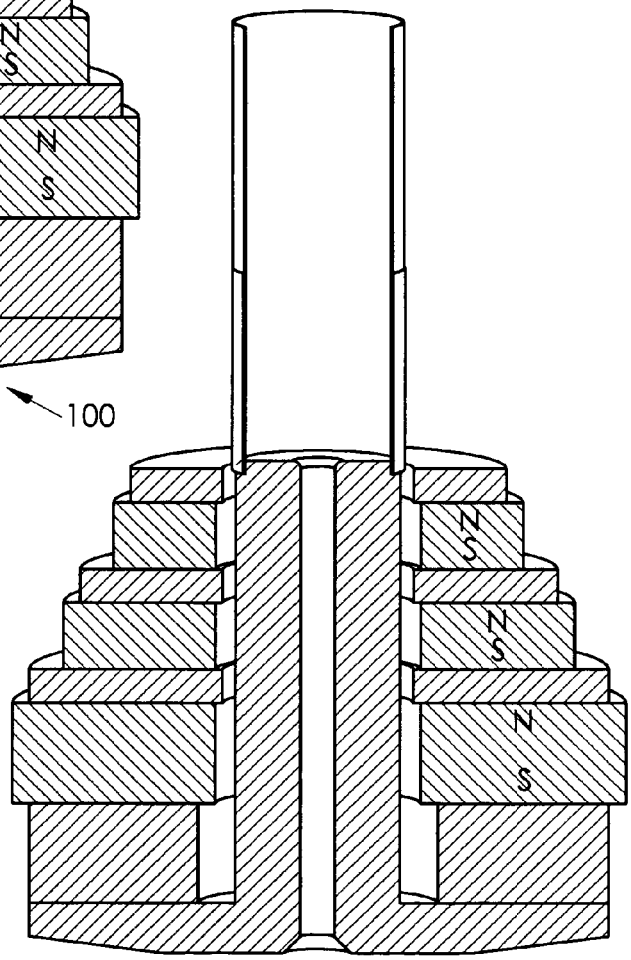

This configuration has the equivalent of two magnetic air gaps - 66% of the total - active over the entire linear excursion. In FIG. 5A, the middle magnetic air gap is active, and one half of each of the top and bottom magnetic air gaps are active. FIG. 5B illustrates the diaphragm assembly at its most extended linear excursion position, in which the bottom of the voice coil is even with the bottom of the middle magnetic air gap; the top and middle magnetic air gaps are active, and the bottom magnetic air gap is inactive.

As the voice coil continues to extend outward, the middle magnetic air gap progressively becomes inactive. However, because the top magnetic air gap is still active, the speaker does not immediately exhibit high distortion. Instead, one full magnetic air gap (the top one) remains fully active until the position shown in FIG. 5C, where the bottom of the voice coil encounters the bottom of the top magnetic air gap. Only after that point, as the voice coil continues extending outward, does the electromotive drive of the speaker trail off toward zero, at the point shown in FIG. 5D, where the bottom of the voice coil has left the top edge of the top magnetic air gap.

Figure 5E:
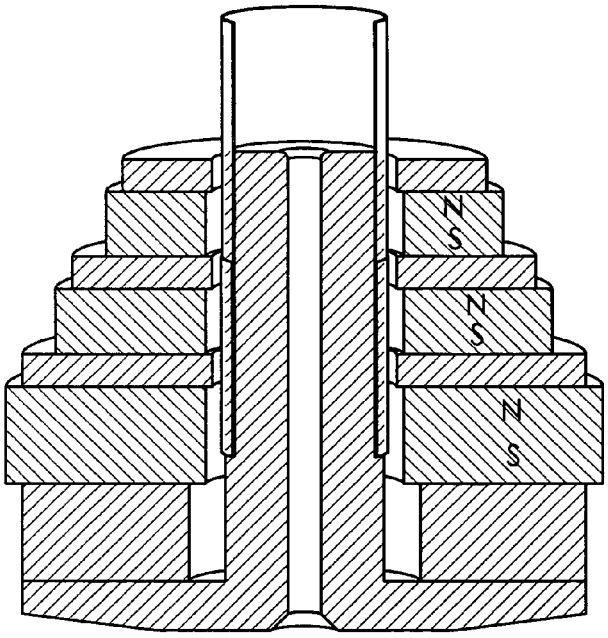
Figure 5F:
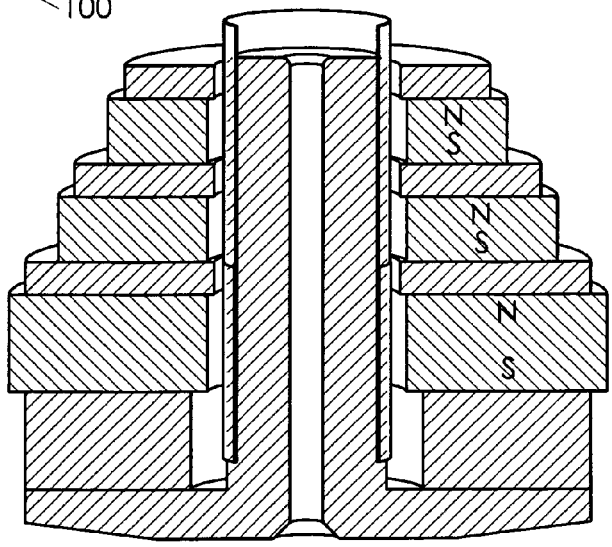

Going in the other direction from the centered position of FIG. 5A, FIG. 5E illustrates the other end of the linear excursion, where the top of the voice coil encounters the top of the middle magnetic air gap. Then, as the voice coil continues withdrawing, the middle magnetic air gap progressively becomes inactive, but the bottom magnetic air gap remains fully active until the position shown in FIG. 5F, where the top of the voice coil encounters the top of the bottom magnetic air gap. As the voice coil then continues withdrawing, the speaker electromotive drive will approach zero when the voice coil completely leaves the bottom magnetic air gap. FIG. 5F clearly demonstrates the purpose of the spacer between the bottom magnet and the pole plate, which is to provide enough space between the bottom magnetic air gap and the pole plate such that the voice coil and bobbin do not strike the pole plate.

This geometry provides good sound quality over an extended dynamic range, due to its stepped function in which there are, in effect, two levels of linear excursion: a center travel region in which two magnetic air gaps are active, and an outer region on either end of this center region, in which one magnetic air gap is active.

Figure 6:
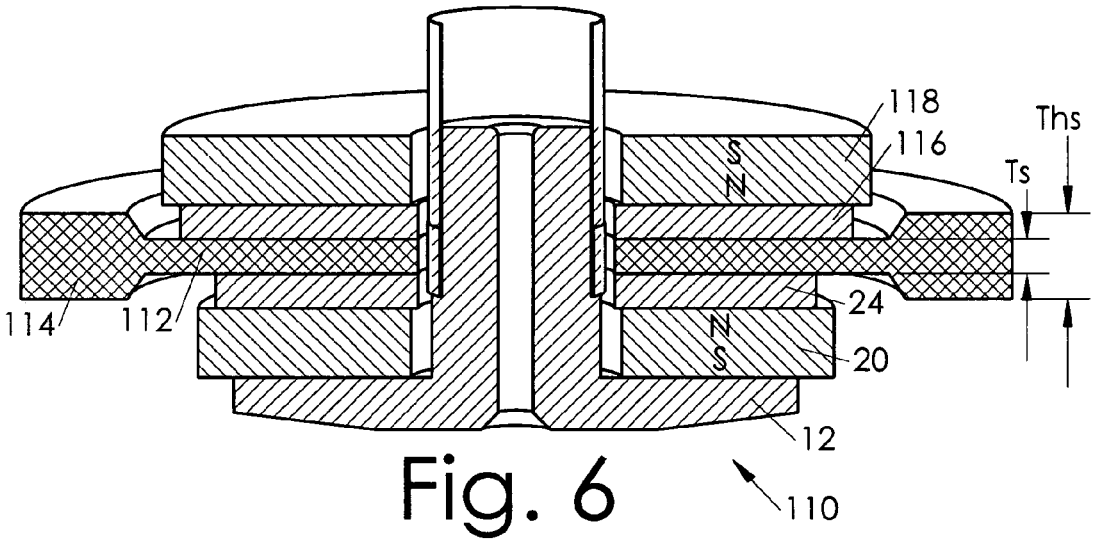
FIG. 6 shows, in cross-section, a fifth embodiment of a speaker geometry, having a cooling device built into the magnet assembly, with two air gaps and one voice coil.

FIG. 6 illustrates a fifth embodiment of a speaker geometry 110 according to this invention. The speaker includes a pole plate 12, first magnet 20, first plate 24, and diaphragm assembly as in the first embodiment. The speaker further includes a heatsink plate 112 which is made of a non-magnetically conductive and, ideally, highly thermally conductive, material such as aluminum. The heatsink plate may advantageously be equipped with a thermal dissipator portion 114 which, in some embodiments, may have a thickness Ths which is substantially greater than the thickness Tsp of the central portion of the heatsink plate. In such embodiments, the overall diameter of the heatsink plate should be sufficiently greater than those of the surrounding components to allow adequate clearance for the thicker heatsink perimeter. Although not illustrated in this cross-section, the heatsink may include axial or radial slots or fins to increase surface area and improve thermal transfer.

The speaker further includes a second plate 116 and a second permanent magnet 118. In this configuration, the second magnet is oriented opposite to the first magnet, so the magnetic flux across the two air gaps is in the same direction, enabling the use of a single voice coil or multiple voice coils generating the same electromagnetic polarity.

Figure 7:
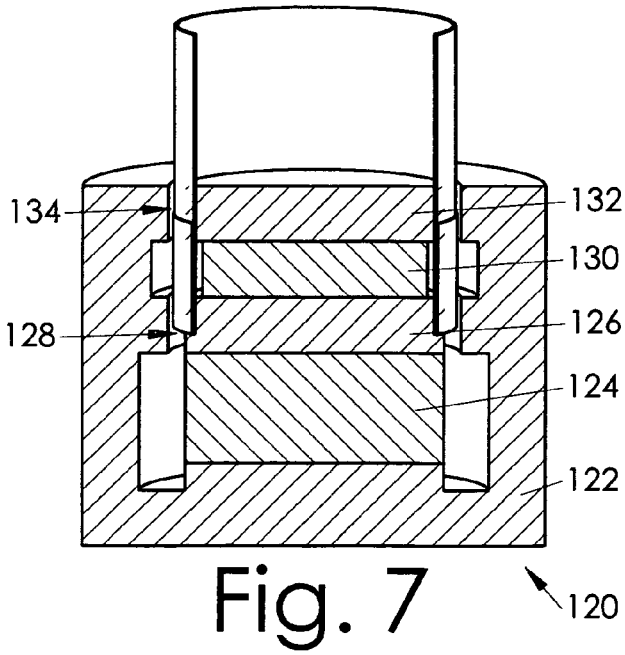
FIG. 7 shows, in cross-section, a sixth embodiment of a speaker geometry, using internal magnets, two air gaps, and one voice coil.

FIG. 7 illustrates a sixth embodiment of a speaker geometry 120 which utilizes internal magnets and plates rather than external ring magnets and plates. Typically, this is the geometry that is employed with neodymium-iron-boron magnets or other rare earth magnets. In this embodiment, the magnetic return path is via an outer perimeter of a yoke or cup 122 rather than via a pole piece. Within the cup are housed an internal magnet 124, a first plate 126 which defines a first magnetic air gap 128, a magnetic material member 130 which may be a permanent magnet or merely a ferrous spacer, and a second plate 132 which defines a second magnetic air gap 134. The bobbin may be equipped with one or more voice coils generating the same polarity and sized as indicated above. In the optimum case, the magnet or spacer 130 may be sized (in diameter) such that the magnetic flux over the top magnetic air gap is substantially the same as the magnetic flux over the bottom magnetic air gap. In some embodiments, the magnet or spacer 130 may be ring shaped. In some embodiments, the top magnet is the same diameter as the bottom magnet, but is made of weaker magnetic material.

In some embodiments, holes (not shown) may be provided through the cup and/or plates and/or magnets to provide air flow to both cool and depressurize the assembly when the voice coil and diaphragm are in heavy movement. In some embodiments, this may be accomplished with one central hole, in an internal ring magnet configuration.

Figure 8:
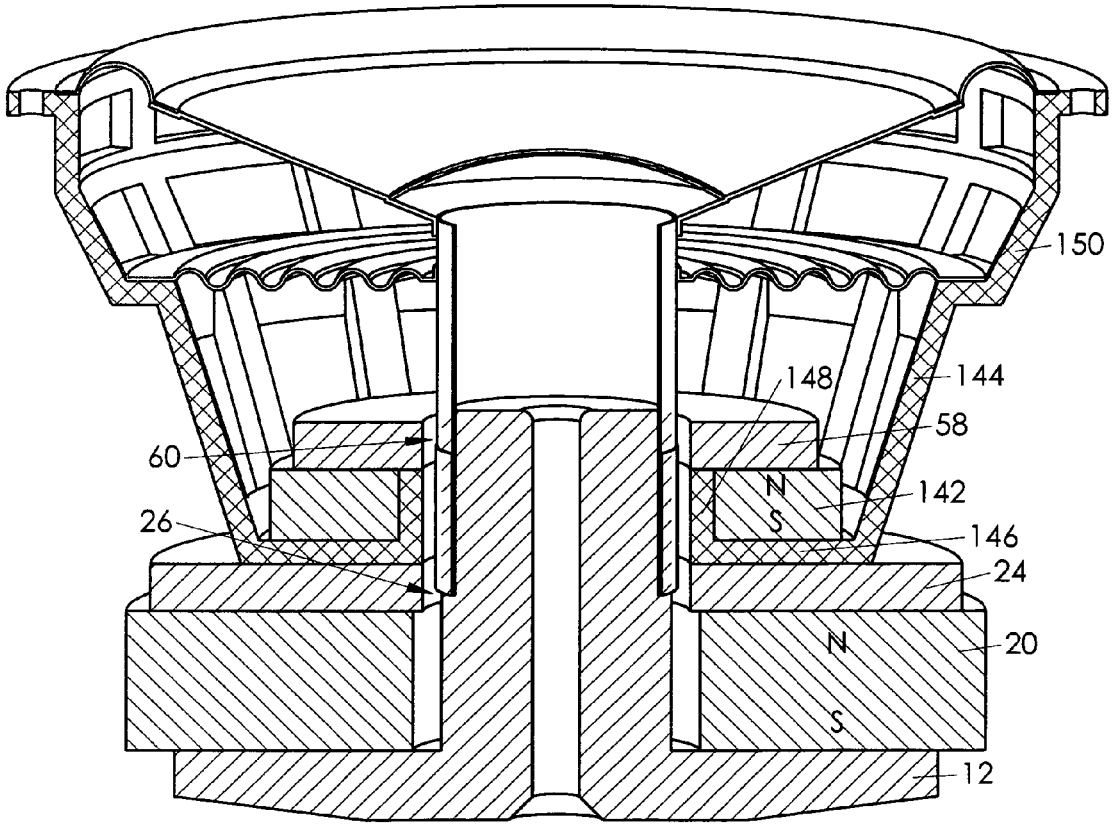
FIG. 8 shows, in cross-section, a seventh embodiment of a speaker geometry, with a unified frame and heatsink.

FIG. 8 illustrates a seventh embodiment of the invention, which is similar to those of FIGS. 2 and 6. The speaker 140 includes a pole plate 12, primary magnet 20, first magnetic air gap plate 24, and second magnetic air gap plate 58, as before. The top magnet 142 has an enlarged inner diameter to accommodate a combined frame and heatsink 144. The heatsink-frame 144 is made of a non-magnetically conductive material, such as aluminum, and includes a portion 146 which is disposed between the first plate and the top magnet, a portion 148 which is disposed within the enlarged inner diameter of the upper magnetic material member such that an enlarged surface area of the heatsink is exposed to the section of the voice coil spanning between the air gaps, and a portion 150 which serves as the frame to support the diaphragm assembly. In some embodiments, the inner surface of the heatsink portion 148 is substantially aligned with, or slightly recessed from, the inner diameters of the two plates.

Figure 9:
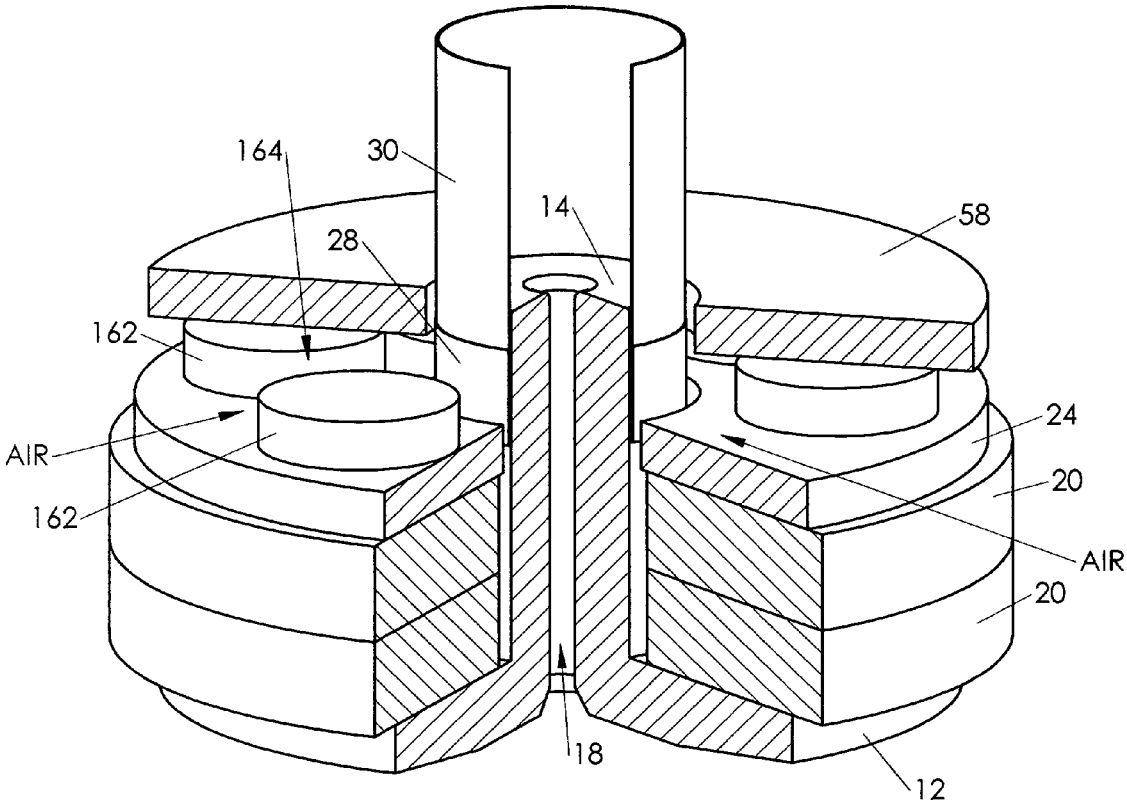
FIG. 9 shows, in top view, an eighth embodiment of a speaker geometry, in which the upper magnet is comprised of a plurality of smaller magnets having spaces between them to permit airflow to cool the voice coil.

FIG. 9 illustrates an alternative embodiment which may optionally be practiced in combination with other principles taught herein. Portions of a motor assembly 160 are shown in top view. From the top, the pole piece 14 is visible, with its optional air vent hole 18. The bobbin 30 and voice coil 28 are seen in cross-section when viewed from above. The bottom, primary magnet 20 is visible and disposed about the pole piece. The first plate 24 is disposed about the pole piece, and is magnetically coupled to the bottom magnet. The second plate is not shown, so that the reader can see the multiple top magnetic material members 162 which are disposed about the axis of the motor. Spaces 164 exist between adjacent top magnetic material members, to permit airflow in and out of the motor structure, to improve cooling. In some embodiments, the motor structure may include a screen or mesh (not shown) to prevent foreign particles from entering into the motor through the spaces between the top magnets. The top magnets 162 have their magnetic poles aligned such that e.g. their North poles are facing out of the page. The skilled reader will appreciate that the top magnets are not necessarily of a round disc shape, and that other shapes, with or without holes, will offer different advantages. For example, a set of wedge-shaped top magnets will offer increased surface area and increased magnetic flux across the top magnetic air gap (not shown).

The total linear excursion in single voice coil embodiments of a speaker according to the principles taught in this patent is substantially equal to:

$$((NG-K+1)*HS)+((NS-K+1)*HG)$$

where K is the number of magnetic air gaps which the voice coil can have active at a time, NG is the number of magnetic air gaps, NS is the number of spaces between the magnetic air gaps (or, in other words, NG−1), HG is the height of a magnetic air gap, and HS is the height of the space between adjacent magnetic air gaps, as long as K is less than NG.

Figure 10:
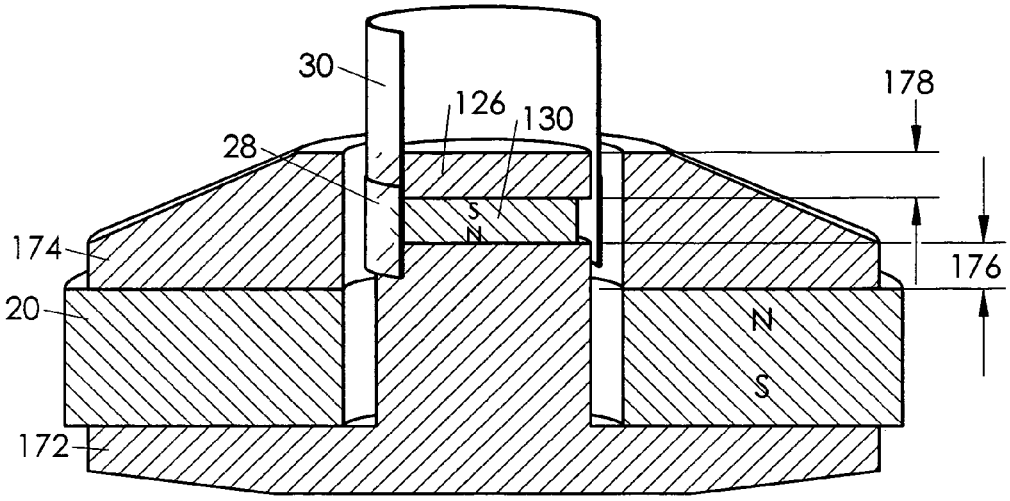
FIG. 10 shows, in cross-section, a ninth embodiment of a speaker geometry using a combination of an external ring magnet as the primary magnet and an internal disc magnet for the upper magnetic air gap.

FIG. 10 illustrates a ninth embodiment of a dual-gap speaker 170 using a hybrid geometry. The speaker includes a pole plate 172 and a primary magnet 20 which is an external ring magnet. An annular external top plate 174 is magnetically coupled to the primary magnet and defines a bottom magnetic air gap 176 between the annular external top plate and the pole piece of the pole plate. An internal top magnet 130, which may be a disc magnet, is magnetically coupled to the top of the pole piece, and has its magnetic poles oriented opposite those of the primary magnet with respect to the axis of the speaker. An internal top plate 126 is magnetically coupled to the internal top magnet. The top magnetic air gap 178 is defined between the annular external top plate and the internal top plate. Magnetic flux over the two magnetic air gaps is in the same direction with respect to the pole piece or magnetic return path member. A voice coil 28 and bobbin 30 assembly rides in the magnetic air gaps.

Figure 11:
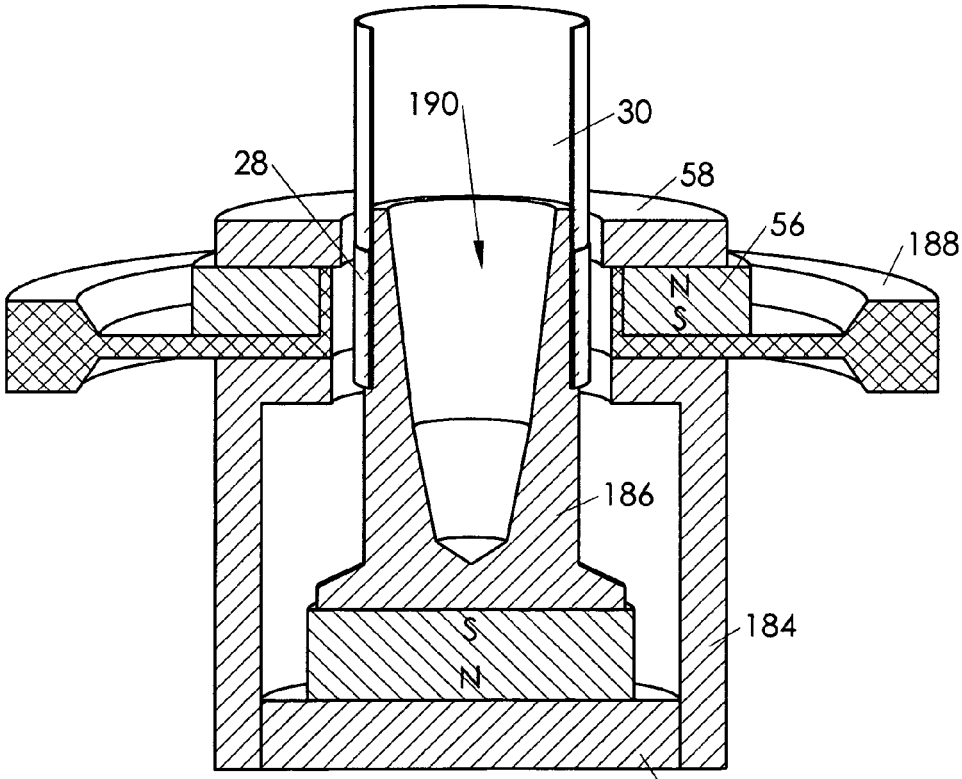
FIG. 11 shows, in cross-section, a tenth embodiment of a speaker geometry using an internal disc magnet as the primary magnet and an external ring magnet for the upper magnetic air gap.

FIG. 11 illustrates a tenth embodiment of a dual-gap speaker 180 using a different hybrid geometry. The speaker includes a cup which may include a back plate 182 and a side wall member 184, or it can be a monolithic structure. An internal magnet 124, which may be a disc magnet, is the primary magnet and is magnetically coupled to the cup. An extended internal top plate member 186, which may alternatively be considered as a pole piece, is magnetically coupled to the primary magnet. An external ring top magnet 56 is magnetically coupled to the cup, optionally over a non-magnetically conductive heatsink 188, and has its magnetic poles oriented opposite those of the primary internal magnet, with respect to the axis of the speaker. An external top plate 58 is magnetically coupled to the external top magnet. The pole piece 186 defines a bottom magnetic air gap between itself and the cup, and a top magnetic air gap between itself and the external top plate. Optionally, the pole piece may be adapted with a hole 190 for reducing its weight and improving cooling of the motor structure. In some embodiments, the hole can extend through the pole piece, the internal primary magnet (which is, then, a ring magnet), and the cup. A voice coil 28 and bobbin 30 assembly rides in the magnetic air gaps.

Radially-Charged Magnets

Figure 12:
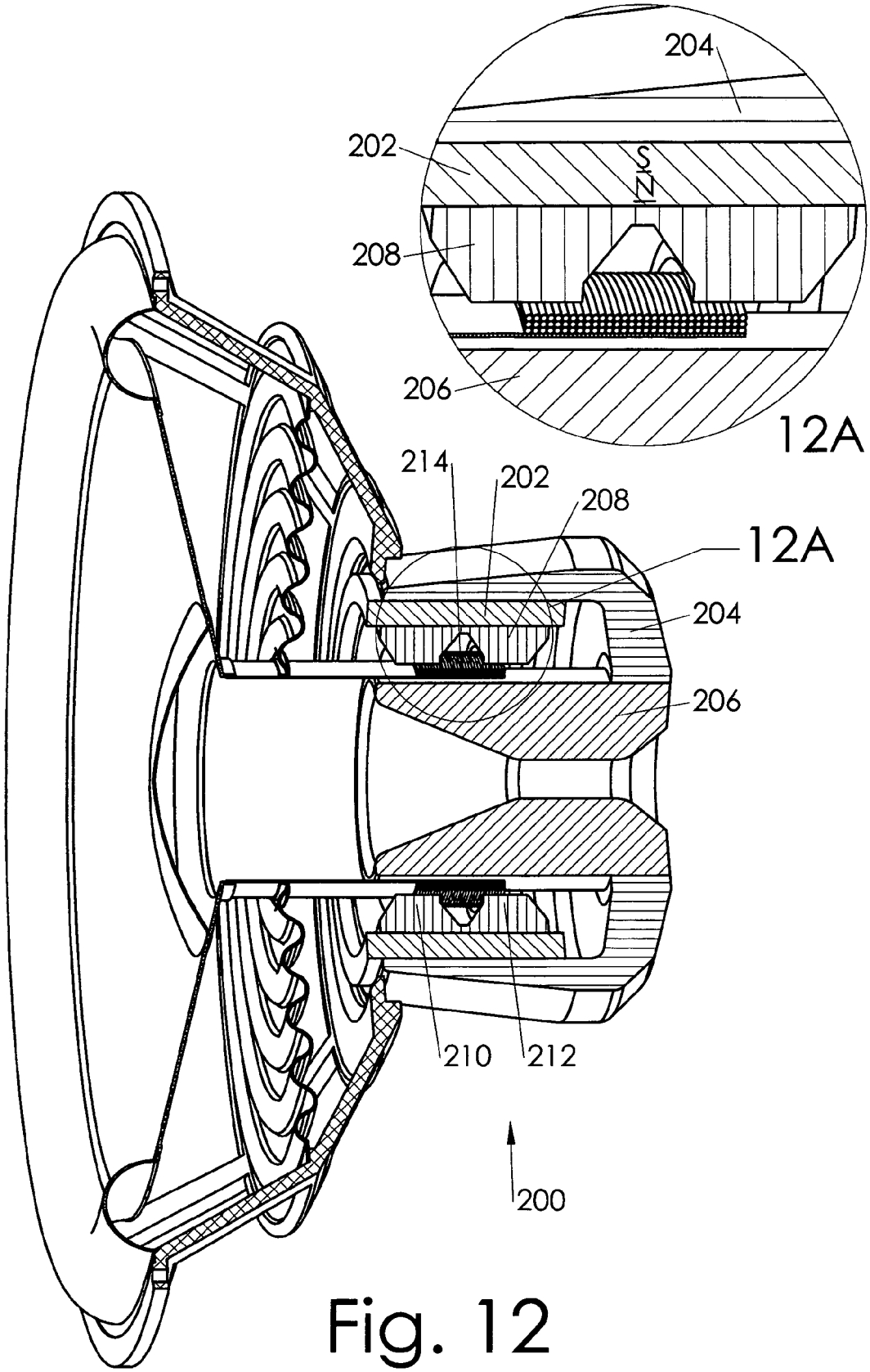
FIGS. 12-20 show various embodiments in which the magnetic flux is provided by radially-charged magnets.

FIG. 12 and detail view 12A illustrate an electromagnetic transducer 200 having another embodiment of a dual-gap motor structure. The motor structure includes a radially-charged magnet 202 which is disposed within a cup 204. The cup includes a pole piece 206 which may be integral with the cup, or which may be a separate component coupled to the cup as shown. The cup and pole piece are made of a magnetically conductive material such as steel. A dual-gap focusing ring 208 is magnetically coupled to the inner diameter of the radially-charged magnet. The focusing ring is made of a magnetically conductive material such as steel, and includes an upper member 210 which defines an upper magnetic air gap with the pole piece, and a lower member 212 which defines a lower magnetic air gap with the pole piece.

In one embodiment, a single voice coil 214 extends from the center of the upper magnetic air gap to the center of the lower magnetic air gap.

Even though the motor structure includes a cup, it is considered an external magnet motor structure, because the magnet is outside the voice coil assembly.

Figure 13:
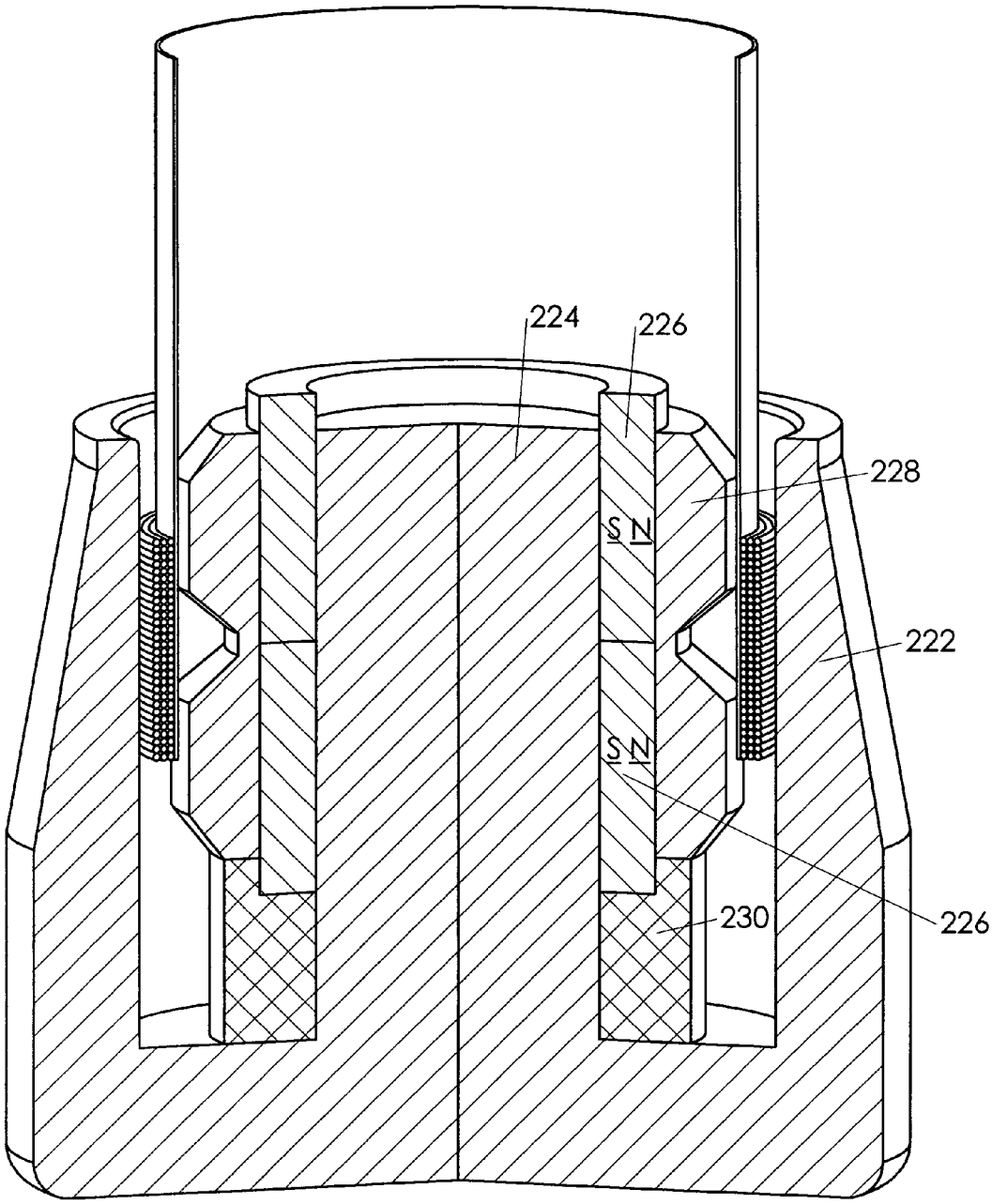

FIG. 13 illustrates an internal magnet motor structure 220. The motor structure includes a cup 222 and a pole piece 224 which may be of monolithic construction, as shown, or separate components coupled together. The motor structure includes one or more radially-charged magnets 226 magnetically coupled between the pole piece and a dual-gap focusing ring 228. An optional magnetically non-conductive spacer 230 holds the magnet and the focusing ring in their correct axial positions. A voice coil is disposed in the magnetic air gaps between the focusing ring and the generally cylindrical inner portion of the cup.

Figure 14:
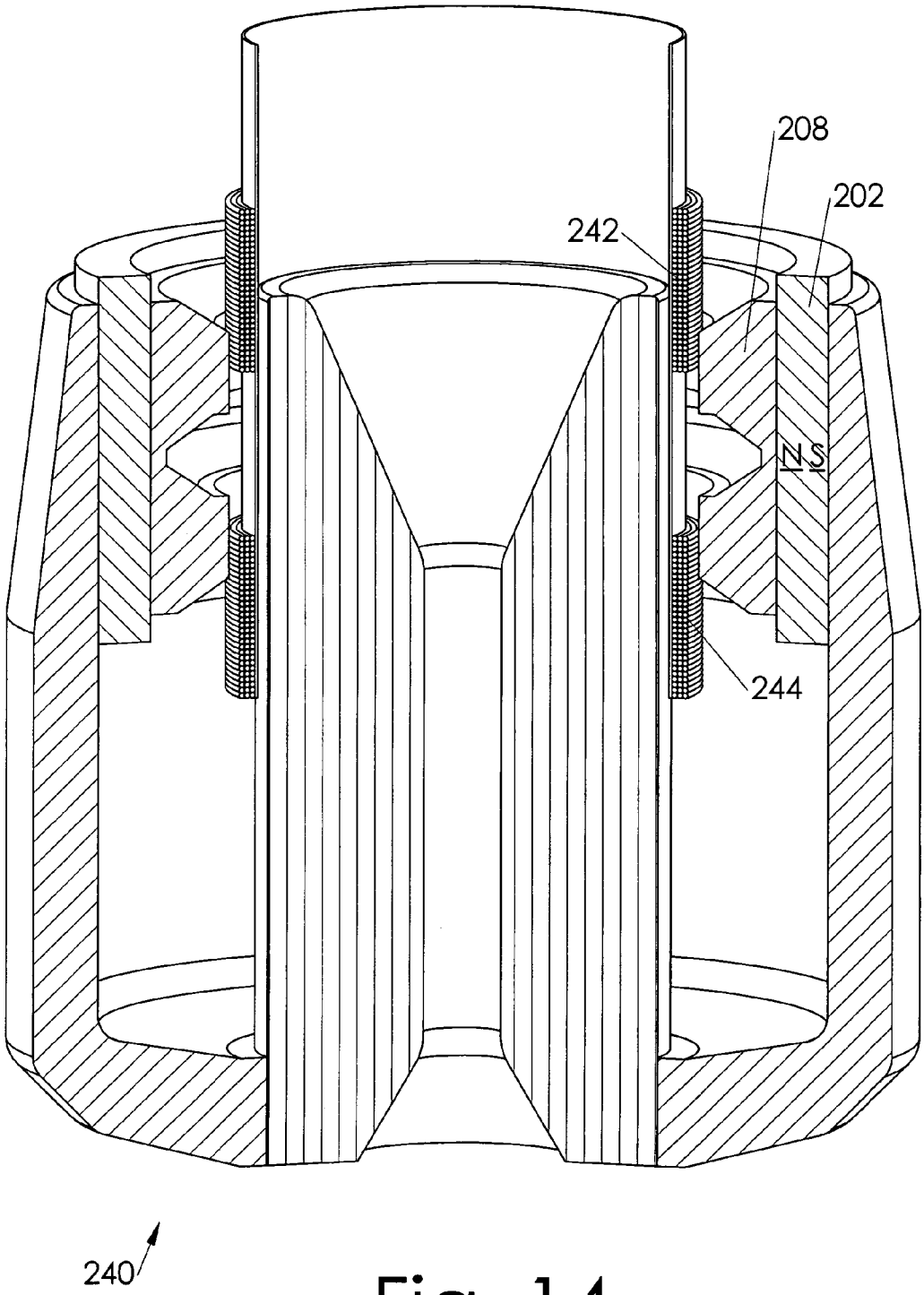

FIG. 14 illustrates another embodiment of a motor structure 240 having an external radially-charged magnet 202 and a dual-gap focusing ring 208 which defines two magnetic air gaps with the pole piece. Two voice coils 242, 244 are disposed within the magnetic air gaps. In the embodiment shown, the voice coils are semi-overhung (each having greater geometric axial height than the axial height of its respective magnetic air gap, and offset from the center of the gap), and are coupled to the bobbin so as to extend from the center of their respective magnetic air gaps outward, in a "coils outside gaps" configuration.

Figure 15:
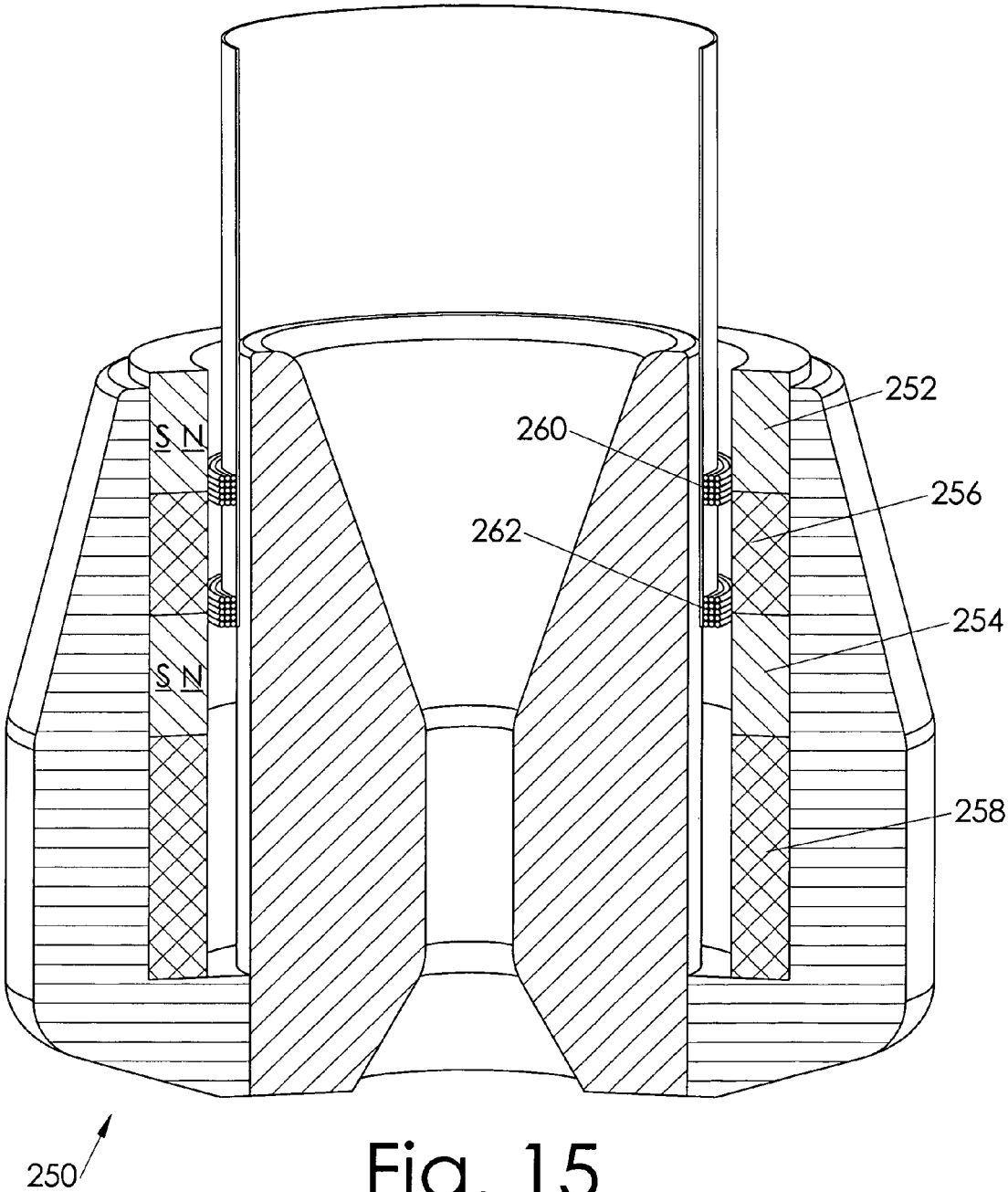

FIG. 15 illustrates another embodiment of a motor structure 250 which does not use a dual-gap focusing ring. Instead, the motor structure includes an upper radially-charged magnet 252 which directly defines an upper magnetic air gap with the pole piece, and a lower radially-charged magnet 254 which directly defines a lower magnetic air gap with the pole piece. An optional aluminum spacer 256 separates the upper and lower magnets, and an optional aluminum spacer 258 supports the lower magnet.

In the embodiment shown, the voice coil assembly includes a pair of semi-underhung voice coils 260, 262 coupled to the bobbin such that the upper half of the upper voice coil is in the upper magnetic air gap, and the lower half of the lower voice coil is in the lower magnetic air gap. The voice coils have a "coils inside gaps" configuration.

Figure 16:
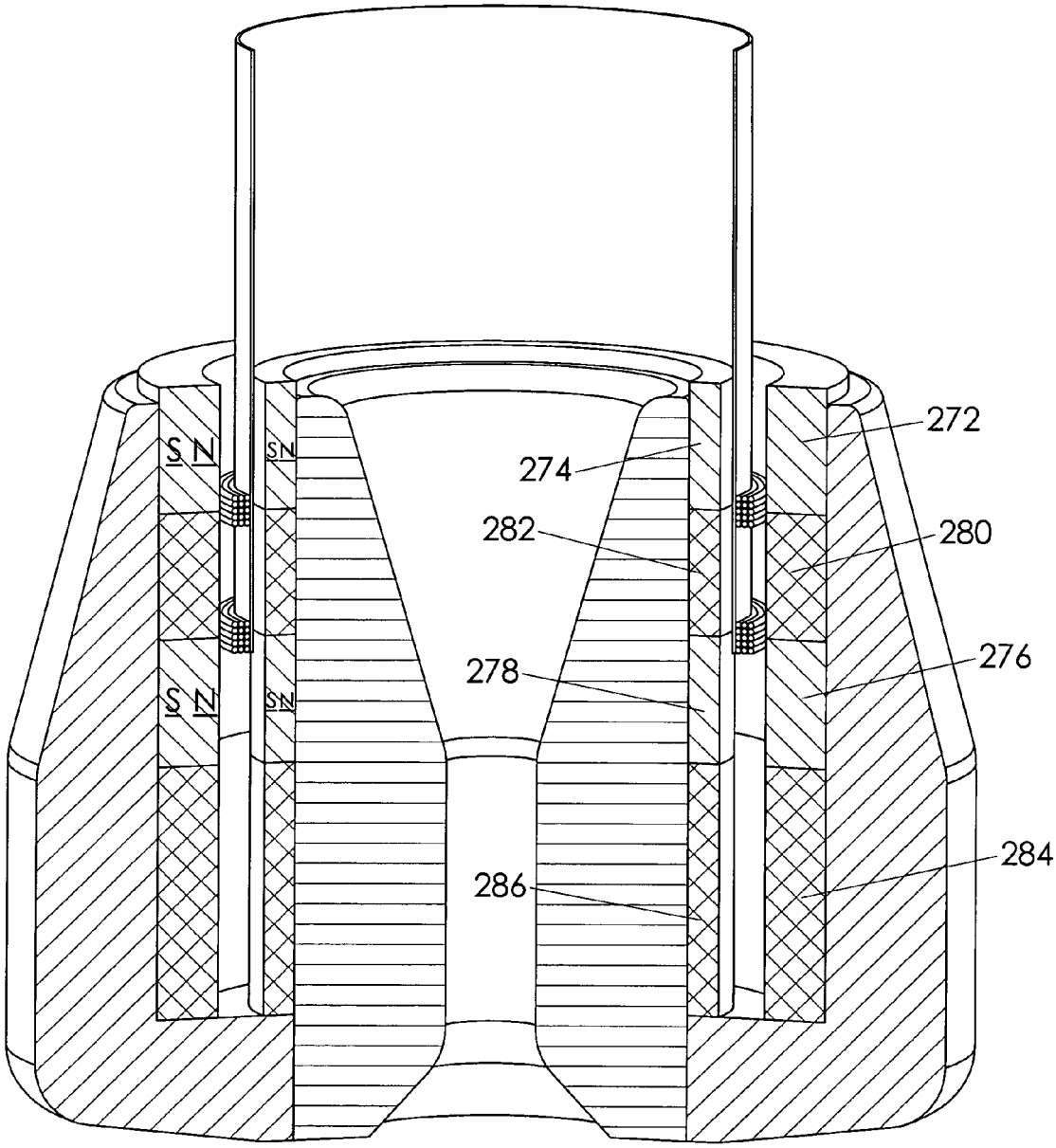

FIG. 16 illustrates another embodiment of a motor structure 270. The motor structure includes both internal and external radially-charged magnets. An upper external magnet 272 is axially aligned with an upper internal magnet 274. Both are charged in the same radial direction, e.g. inward. A lower external magnet 276 is axially aligned with a lower internal magnet 278. Both are charged in the same radial direction, e.g. inward.

An upper external aluminum spacer 280 is disposed between the upper and lower external magnets, and serves not only to keep them in correct axial positions, but also to serve as a shorting ring and sink induced eddy currents, preventing induction heating of the motor structure and reducing flux modulation and thermal compression. An upper internal aluminum spacer 282 is disposed between the upper and lower internal magnets, and serves the same purpose. Clearance spacers 284, 286 provide clearance to prevent voice coil bottoming, and provide correct axial positioning of the lower magnets.

This motor structure has an increased parts count, which will increase its manufacturing cost. However, having radially charged magnets on both sides of the magnetic air gap not only increases the magnetic flux density in the gaps, but also provides significant focusing of the flux within the gaps, reducing fringing effects.

Figure 17:
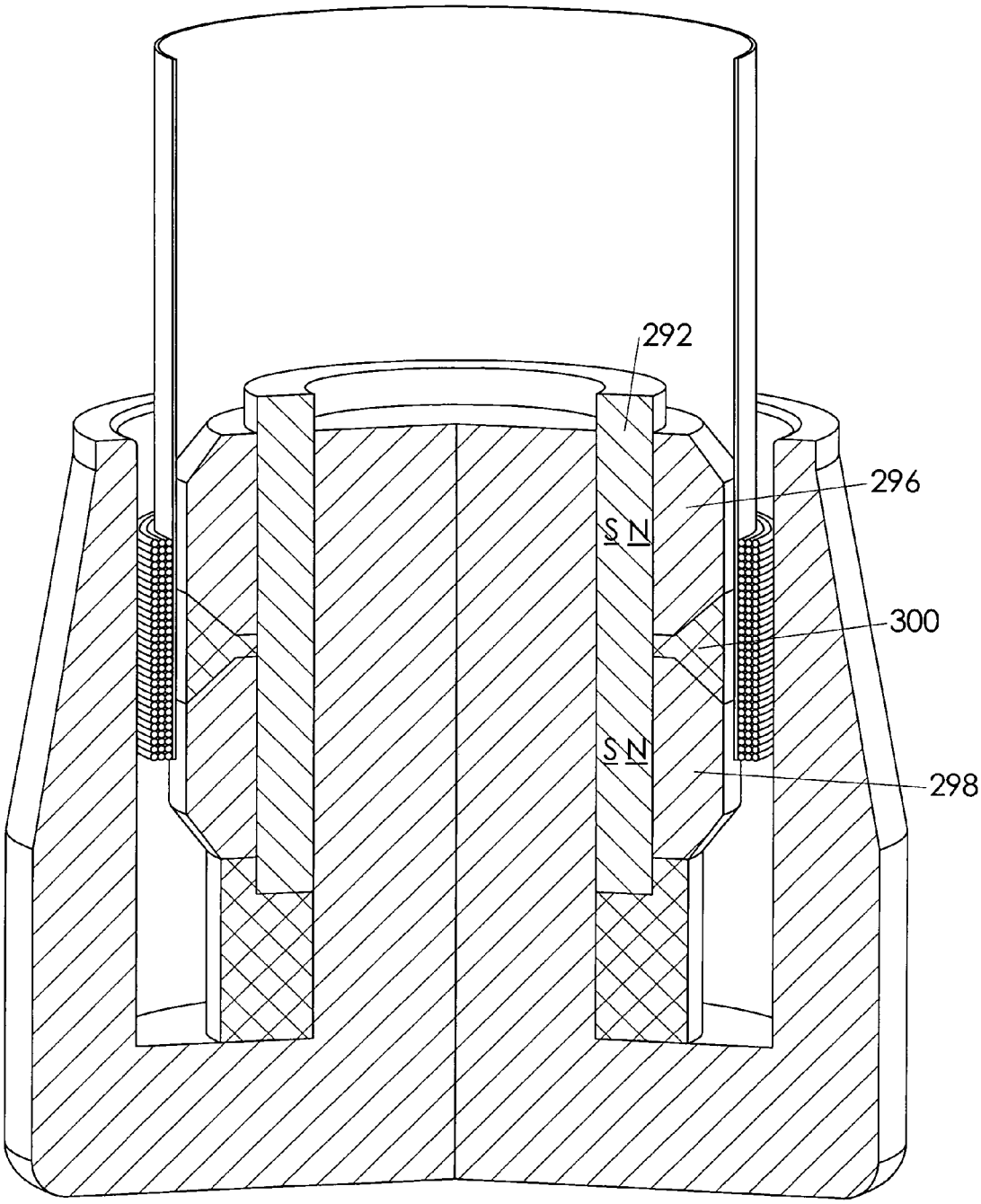

FIG. 17 illustrates another embodiment of a motor structure 290, in which each magnetic air gap is formed by its own distinct focusing ring. The motor structure includes a yoke, one or more radially-charged magnets 292, and two or more focusing rings 296, 298 each defining a respective magnetic air gap with the yoke. Optionally, an aluminum shorting ring 300 is disposed between the focusing rings and serves to provide the correct axial distance between them.

Figure 18:
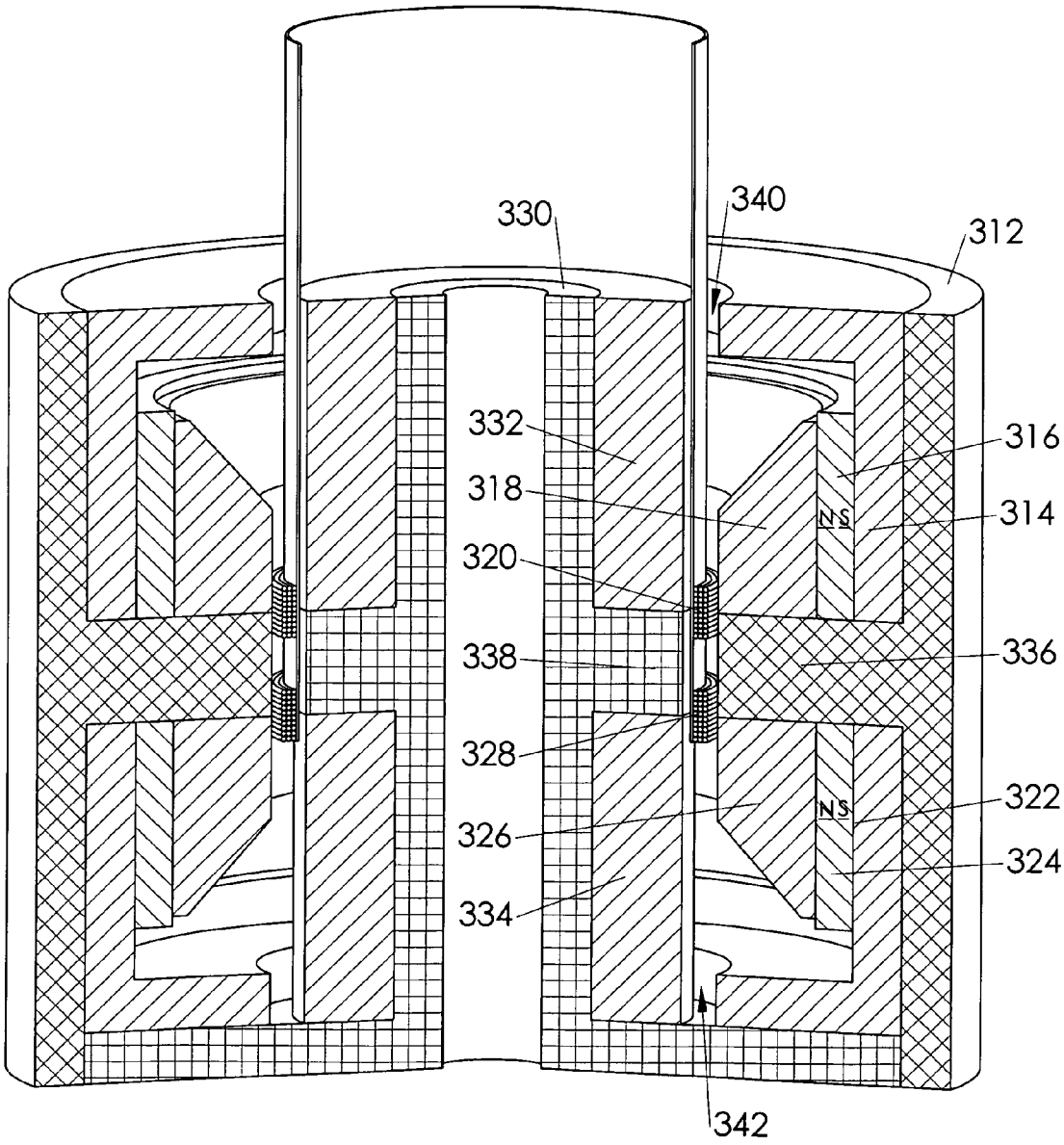

FIG. 18 illustrates a motor structure 310 according to yet another embodiment of this invention. An outer non-magnetic carrier 312 is coupled to an upper yoke 314. An upper radially-charged magnet 316 is magnetically coupled to the upper yoke, and an upper focusing ring 318 is magnetically coupled to the upper magnet. A lower yoke 322 is also coupled to the outer carrier. A lower radially-charged magnet 324 is magnetically coupled to the lower yoke and charged in the same direction as the upper magnet, and a lower focusing ring 326 is magnetically coupled to the lower magnet.

A non-magnetic inner carrier 330 is coupled to an upper pole piece 332 and a lower pole piece 334. The upper focusing ring forms an upper magnetic air gap with the upper pole piece, and the lower focusing ring forms a lower magnetic air gap with the lower pole piece. An upper voice coil 320 is disposed at least partially within the upper magnetic air gap, and a lower voice coil 328 is disposed at least partially within the lower magnetic air gap.

The outer carrier includes a spacer 336, and the inner carrier includes a corresponding spacer 338, which determine the axial distance between the magnetic air gaps. In one embodiment, the axial thickness of these spacers is equal to the geometric height of either of the magnetic air gaps, e.g. 20 mm. In one such embodiment, the axial height of each voice coil is half that height, and the space between the voice coils is equal to the height of one voice coil, e.g. 10 mm.

The upper yoke defines a low reluctance return path air gap 340 with the upper yoke, through which the bobbin extends. The magnetic flux over this gap is in the opposite direction as the magnetic flux over the upper magnetic air gap, and thus this gap serves as a braking gap under extreme outward excursion of the voice coil assembly.

Optionally, the lower magnetic circuit is similarly constructed, with a low reluctance braking gap 342 between the lower yoke and the lower pole piece. In one embodiment, the upper and lower magnetic circuits may be constructed of identical components, inverted in one instance.

The carriers 312 and 330 may optionally be constructed of a thermally conductive and/or electrically conductive material, in order to increase power handling and to lower distortion.

Figure 19:
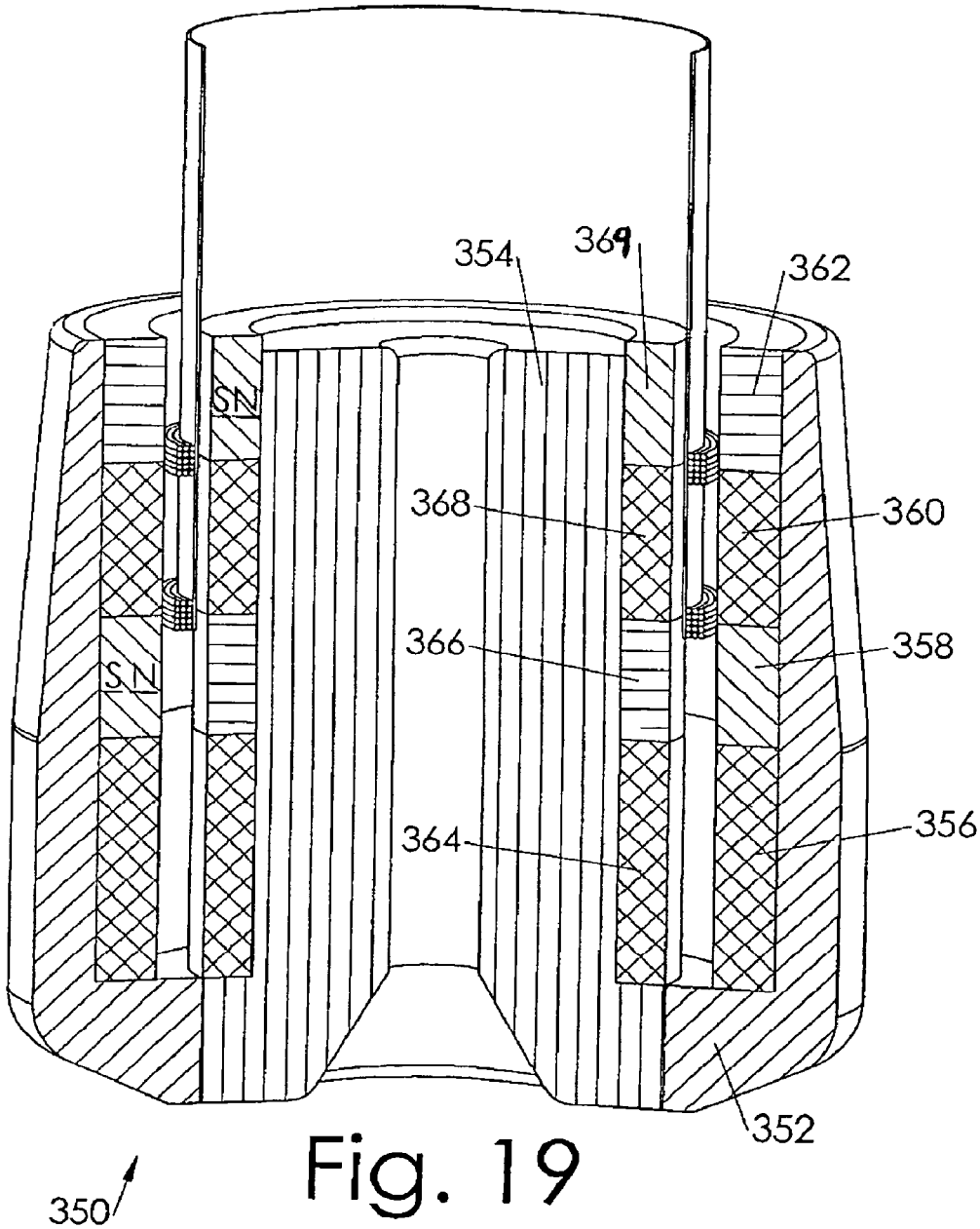

FIG. 19 illustrates another embodiment of a motor structure 350. The motor structure includes a cup 352 magnetically coupled to a pole piece 354. A non-magnetic spacer 356 is coupled to the inner diameter of the cup and supports a radially-charged magnet 358 which is magnetically coupled to the inner diameter of the cup. A non-magnetic spacer 360 is coupled to the inner diameter of the cup and provides correct separation between the magnet and a magnetically conductive ring 362 which is magnetically coupled to the inner diameter of the cup.

A non-magnetic spacer 364 is coupled to the outer diameter of the pole piece and supports a magnetically conductive ring 366. The ring 366 and the magnet 358 define a lower magnetic air gap. A non-magnetic spacer 368 is coupled to the outer diameter of the pole piece and provides correct separation between the steel ring 366 and a radially-charged magnet 369 which is magnetically coupled to the outer diameter of the pole piece. The ring 362 and the magnet 368 define an upper magnetic air gap.

In one embodiment both magnets are charged in the same orientation, e.g. radially inward, and the voice coils are wound in the same direction, such that the motor structure has a push-push configuration.

Components 366 and 354 may be of monolithic construction, eliminated the need for the spacer 364 to function as a support. The same is true of the cup and ring 358. However, it may still be desirable to have components 364 and 356 as shorting rings.

In any of the foregoing embodiments, the radially-charged magnet(s) may be constructed as a group of two or more smaller magnets. In some such embodiments, the smaller magnets form a continuous annulus, while in others there may be spaces between them.

In some embodiments, the inner or outer diameter of the magnet segments may not have a cylindrical or rounded surface. For example, they may have a flat surface, and the focusing ring and/or cup and/or pole piece may have corresponding polygonal surfaces to mate with the magnet segments and still provide a cylindrical magnetic air gap.

Figure 20:
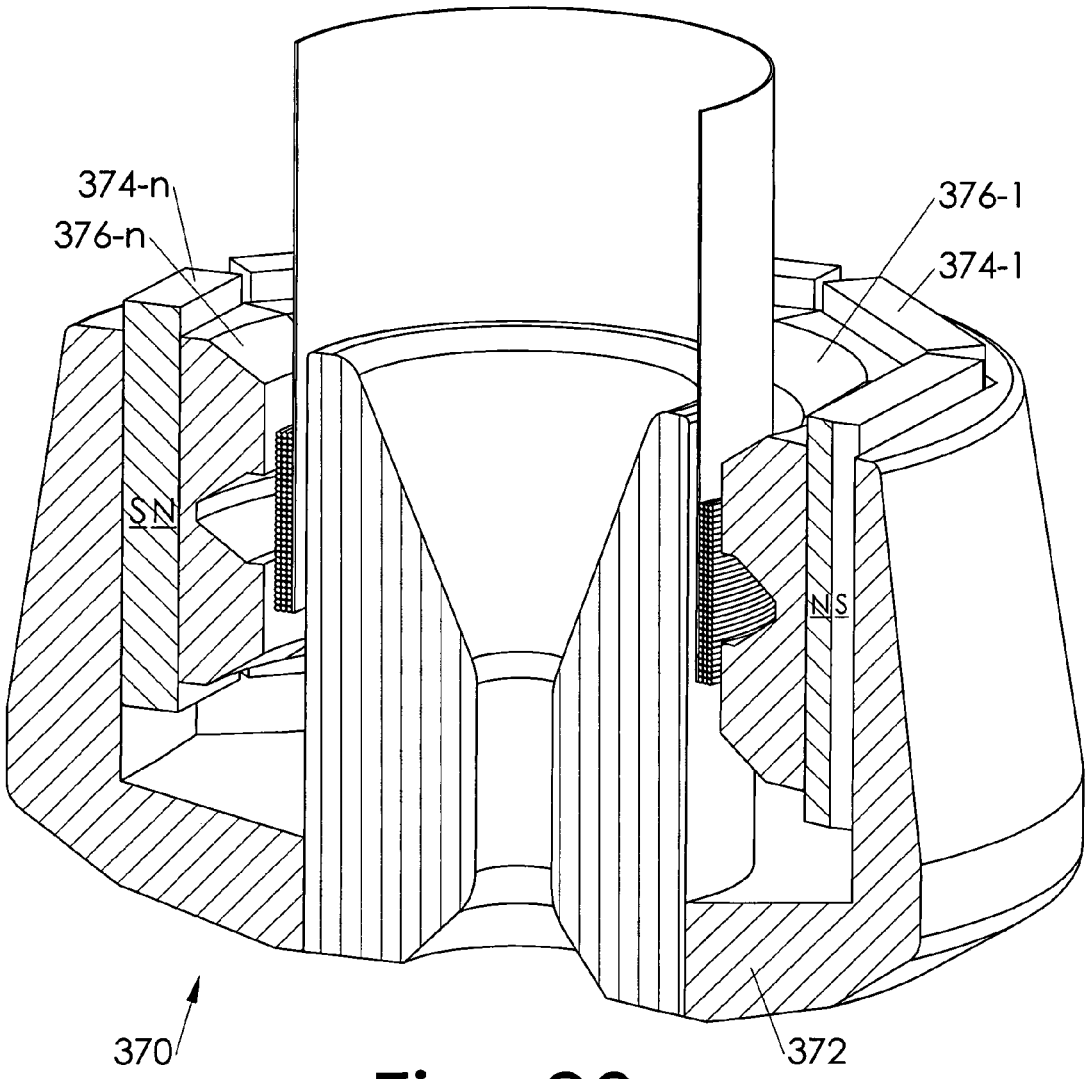

FIG. 20 illustrates one such motor structure 370. The motor structure includes a cup 372 having an octagonal, rather than cylindrical, inner surface. Eight flat radially-charged magnets 374 are magnetically coupled to respective flat surfaces of the inner surface of the cup. Eight corresponding dual-gap focusing ring segments 376 are magnetically coupled to the respective magnets. Each focusing ring segment has a flat outer surface for mating with a magnet, and a cylindrical inner surface for forming the magnetic air gaps with the pole piece. In another embodiment, a single, monolithic focusing ring is used, which includes a suitable polygonal outer surface for mating with the flat magnets.

In other embodiments, the flat magnet geometry may be used with internal magnets, in which case the pole piece rather than the cup is adapted with a polygonal mating surface.

CONCLUSION

In magnetic circuits such as those used in electromagnetic transducer motor structures, it is desirable to maximize the magnet surface area of those surfaces from which the magnetic flux lines extend. In conventional, axially-charged magnet circuits, this is accomplished by making the motor structure as radially wide as acceptable. However, in a radially-charged magnet circuit, this means making the motor structure as axially tall as acceptable.

In any of the radially-charged magnet embodiments, the magnets may be powerful rare earth magnets such as those made from neodymium-iron-boron.

In some embodiments, the radially-charged magnet has a cross-section aspect ratio which is axially taller than it is radially thick (meaning the cross-section of one "side" of the magnet, not the entire annulus). In one such embodiment, the radially-charged magnet has a cross-section which is at least 1.5 times as tall as it is wide. In another, the radially-charged magnet has a cross-section which is at least 2 times as tall as it is wide. In yet another, the radially-charged magnet has a cross-section which is at least 4 times as tall as it is wide. In some embodiments, these aspect ratios refer to each of the one or more magnets individually. In others, they refer to the one or more magnets in the aggregate, disregarding any spacers between them.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the claims, the phrase "magnetically coupled to" is intended to mean "in magnetic communication with" or in other words "in a magnetic flux circuit with", and not "mechanically affixed to by means of magnetic attraction." In the claims, the phrase "air gap" is intended to mean "gap over which magnetic flux is concentrated" and not limited to the case where such gap is actually filled with air; the gap could, in some applications, be filled with any suitable gas or liquid such as magnetic fluid, or even be under vacuum.

When one component is said to be "adjacent" another component, it should not be interpreted to mean that there is absolutely nothing between the two components, only that they are in the order indicated.

The several features illustrated in the various figures may be combined in many ways, and should not be interpreted as though limited to the specific embodiments in which they were explained and shown.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An electromagnetic transducer motor structure comprising:

a yoke having an axis and including a cup and a pole magnetically coupled to the cup;

at least one radially charged external magnet magnetically coupled to the cup; and an upper magnetic air gap and a lower magnetic air gap over which magnetic flux flows between the magnet and the other of the cup and the pole piece;

wherein magnetic flux over the upper and lower magnetic air gaps is in a first same radial direction with respect to the axis; and a magnetically conductive focusing ring means magnetically coupled to an inner surface of the external magnet and defining the upper and lower magnetic air gaps.

2. The electromagnetic transducer motor structure of claim 1 wherein;

the focusing ring means comprises a first component defining the upper magnetic air gap and a second component distinct from the first component and defining the lower magnetic air gap.

3. The electromagnetic transducer motor structure of claim 2 further comprising:

an electrically conductive shorting ring disposed between the first component and the second component of the focusing ring means.

4. The electromagnetic transducer motor structure of claim 1 wherein:

the cup includes an inner surface having a plurality of flat segments;

the focusing ring means includes an outer surface having a plurality of flat segments; and the radially charged external magnet comprises a plurality of distinct flat magnet segments each magnetically coupled between a corresponding one of the flat segments of the cup and a corresponding one of the flat segments of the focusing ring means.

5. An electromagnetic transducer comprising:

a yoke having an axis and including a cup and a pole piece magnetical1v coupled to the cup;

at least one radially charged external magnet magnetically coupled to the cup; and an upper magnetic air gap and a lower magnetic air gap over which magnetic flux flows between the magnet and the other of the cup and the pole piece;

wherein magnetic flux over the upper and lower magnetic air gaps is in a first same radial direction with respect to the axis;

a diaphragm assembly having a voice coil disposed at least partially in one of the magnetic air gaps; and a single voice coil extending substantially from a center of the upper magnetic air gap substantially to a center of the lower magnetic air gap.

6. An electromagnetic transducer comprising:

a yoke having an axis and including a cup and a pole piece magnetically coupled to the cup;

at least one radially charged external magnet magnetically coupled to the cup; and an upper magnetic air gap and a lower magnetic air gap over which magnetic flux flows between the magnetic and the other of the cup and the vole piece;

wherein magnetic flux over the upper and lower magnetic air gaps is in a first same radial direction with respect to the axis; and a diaphragm assembly having, a first voice coil extending from the upper magnetic air gap in a first axial direction, and a second voice coil extending substantially from the lower magnetic air gap in a second direction opposite the first direction.

wherein magnetic flux over the upper and lower magnetic air gaps is in a first same radial direction with respect to the axis.

7. An electromagnetic transducer motor structure comprising:

a yoke having an axis and including cup and a pole piece magnetically coupled to the cup;

a first radially charged external magnet magnetically coupled to the cup and defining an upper magnetic air gap to the pole piece; and a second radially charged external magnet magnetically coupled to the cup and defining a lower magnetic air gas to the pole piece;

wherein magnetic flux over the upper and lower magnetic air gaps is in a first same radial direction with respect to the axis; and an electrically conductive shorting ring disposed between the first radially charged external magnet and the second radially charged external magnet.

8. The electromagnetic transducer motor structure of claim 7 further comprising:

a first radially charged internal magnet magnetically coupled to the pole piece at the upper magnetic air gap; and a second radially charged internal magnet magnetically coupled to the pole piece at the lower magnetic air gap

9. An electromagnetic transducer comprising:

a yoke having an axis and including a cup and a pole piece magnetically coupled to the cup;

a first radially charged external magnet magnetically coupled to the cup and defining an upper magnetic air gap to the pole piece; and a second radially charged external magnet magnetically coupled to the cup and defining a lower magnetic air gap to the pole piece;

wherein magnetic flux over the upper and lower magnetic air gaps is in a first same radial direction with respect to the axis;

a diaphragm assembly having a voice coil disposed at least partially in one of the magnetic air gaps;

wherein the voice coil comprises a single voice coil extending substantially from a center of the upper magnetic air gap substantially to a center of the lower magnetic air gap.

10. An electromagnetic transducer comprising;

a yoke having an axis and including a cup and a pole piece magnetically coupled to the cup;

a first radially chained external magnet magnetically coupled to the cup and defining an upper magnetic air gap to the pole piece; and a second radially charged eternal magnet magnetically coupled to the cup and defining a lower magnetic air gap to the pole piece;

wherein magnetic flux over the upper and lower magnetic air gaps is in a first same radial direction with respect to the axis;

a diaphragm assembly having a voice coil disposed at least partially in one of the magnetic air gaps;

wherein the voice coil comprises, a first voice coil extending from the upper magnetic air gap in a first axial direction, and a second voice coil extending substantially from the lower magnetic air gap in a second direction opposite the first direction.

* * * * *